US007267463B2

(12) United States Patent
Bayer et al.

(10) Patent No.: US 7,267,463 B2
(45) Date of Patent: Sep. 11, 2007

(54) ORNAMENTAL FIXTURES HAVING DECORATIVE ORNAMENTS

(75) Inventors: Georg Bayer, Plattsburgh, NY (US); Andrew Schuyler, Colchester, VT (US); Andrew Schonbek, Plattsburgh, NY (US); Tho Ly, Plattsburgh, NY (US); Chad Recore, Peru, NY (US)

(73) Assignee: Schonbek Worldwide Lighting, Inc., Plattsburgh, NY (US)

( * ) Notice: Subject to any disclaimer, the term of this patent is extended or adjusted under 35 U.S.C. 154(b) by 132 days.

(21) Appl. No.: 11/031,153

(22) Filed: Jan. 7, 2005

(65) Prior Publication Data

US 2005/0157502 A1 Jul. 21, 2005

Related U.S. Application Data

(63) Continuation-in-part of application No. 10/757,628, filed on Jan. 14, 2004, now Pat. No. 7,101,065.

(51) Int. Cl.
*F21V 5/06* (2006.01)

(52) U.S. Cl. ..... 362/441; 362/330; 362/433

(58) Field of Classification Search ..... 362/249, 362/252, 330, 311, 312, 383, 455, 456, 404, 362/405, 408, 433, 441, 442, 806, 457, 458
See application file for complete search history.

(56) References Cited

U.S. PATENT DOCUMENTS 3,820,201 A 6/1974 Burckhardt ..... 24/87 R (Continued)

FOREIGN PATENT DOCUMENTS

DE 2127913 12/1972

(Continued)

OTHER PUBLICATIONS

Notification Concerning Transmittal of Copy of International Preliminary Report on Patentability (Chapter 1 of the Patent Cooperation Treaty) (PCT Rule 44bis.1(c)) (From PCT/IB/326), International Preliminary Report on Patentability (Form PCT/IB/373) dated Jul. 27, 2006; and Written Opinion of International Searching Authority (PCT Rule 43bis.1) (PCT/ISA/237) of corresponding International Application No. PCT/US2005/003658, filed Jan. 10, 2005.

*Primary Examiner*—Laura K. Tso
(74) *Attorney, Agent, or Firm*—Heslin Rothenberg Farley & Mesiti P.C.; John Pietrangelo

(57) ABSTRACT

Arrangements and methods for mounting decorative ornaments and fixtures having decorative ornaments are disclosed. The decorative ornaments may be, for example, beads, crystals, or gems. In one aspect, an arrangement is provided including a frame having an aperture and at least one ornament mounting post projecting from the frame, wherein the ornament is retained by the mounting post when the ornament is mounted on the mounting post. The ornament is mounted to the post by first deflecting the post to a first position, mounting the ornament, and then deflecting the post to its original position whereby the ornament is retained by the post and the aperture. In one aspect, ornaments may be mounted to apertures in a frame by means of one or more wires, for example, a wire passing through a plurality of ornaments. The arrangements and methods may be used for ornamental fixtures, for example, chandeliers and lamps.

17 Claims, 27 Drawing Sheets

U.S. PATENT DOCUMENTS

| | | | | |
|---|---|---|---|---|
| 5,104,082 | A | 4/1992 | Bayer | 248/303 |
| 5,109,325 | A | 4/1992 | Bayer et al. | 362/433 |
| 5,116,009 | A | 5/1992 | Bayer | 248/303 |
| 5,144,541 | A | 9/1992 | Schonbek | 362/405 |
| 5,241,460 | A | 8/1993 | Schonbek | 362/405 |
| 5,285,364 | A | 2/1994 | Bayer | 362/405 |
| 5,573,330 | A | 11/1996 | Lucas | 362/405 |
| D397,494 | S | 8/1998 | Bayer et al. | D26/154 |
| 5,906,430 | A | 5/1999 | Bayer | 362/404 |
| 5,921,668 | A | 7/1999 | Bayer | 362/404 |
| 6,854,868 | B2 * | 2/2005 | Wu | 362/405 |

FOREIGN PATENT DOCUMENTS

| | | | |
|---|---|---|---|
| DE | 3913470 | C1 | 10/1990 |
| EP | 0 200 924 | A2 | 11/1986 |

* cited by examiner

ORNAMENTAL FIXTURES HAVING DECORATIVE ORNAMENTS

CROSS REFERENCE TO RELATED APPLICATIONS

This application is a continuation-in-part application of and claims priority from U.S. application Ser. No. 10/757,628 filed on Jan. 14, 2004 now U.S. Pat. No. 7,101,065, the disclosure of which is incorporated by reference herein in its entirety.

FIELD OF THE INVENTION

This invention relates, generally, to arrangements for and methods for mounting decorative ornaments, for example, crystals and beads, more particularly, to arrangements and methods for mounting decorative ornaments to lighting fixtures, such as chandeliers.

BACKGROUND OF THE INVENTION

The design of chandeliers, lamps, and various other decorative items often involves the need to attach decorative ornaments or crystal components (for example, octagonal or circular beads, pendants, and other ornaments) to supporting metal frames. According to prior art practice, the attachment of these ornaments to the frames typically requires the use of intricate wires, hooks, or other fastening means, and may require special tools. In addition, prior art mounting arrangements and methods typically require multiple fabrication and assembly steps, multiple parts and/or materials, and are labor intensive and costly to perform. Also, many prior art wire mounting methods typically do not generally allow for the desired positioning or orientatating of some components, such as jewels, pendalogs, or pear shaped pendants, though conventional hooks may provide some orientatating of such ornaments, for example, with the aid of gravity. Systems allowing for the orientation of such components other than by gravity generally require complex and expensive brackets, hooks, or other attachment means. Aspects of the present invention overcome these disadvantages of the prior art, among others, when mounting ornaments in decorative fixtures.

SUMMARY OF ASPECTS OF THE INVENTION

According to aspects of the present invention, ornament mounting arrangements and mounting methods which are easy to fabricate and assemble are provided. Aspects of the invention include mounting arrangements and fixtures having frames having an aperture with a geometry that provides a receptacle (for example, a receiving slot, or a pocket) having a mounting post or wire that is adapted to receive and retain an ornament, specifically, retain an ornament in a predetermined orientation. Aspects of the present invention also provide an ornament mounting frame or fixture that can be fabricated in a single operation, for example, stamping, to produce the pocket and mounting pin. Contrary to prior art arrangements and methods, in one aspect of the invention, few or no additional component parts are needed to attach the ornaments to the mounting frames. In addition, aspects of the present invention provide for the mounting of ornaments whereby the orientation of the ornaments can be controlled, for example, with little or no influence by gravity, without the need for brackets, hooks, or other attachment means. Aspects of the invention also provide methods and devices for providing decorative ornaments to lighting fixtures, for example, to directional lighting fixtures whose orientation can be varied without affecting the orientation and appearance of the ornaments relative to the lighting fixtures. Aspects of the present invention are adaptable to a broad range of frame and ornament configurations and can accommodate a wide variety of different ornaments. In contrast to prior art methods, in aspects of present invention, the assembly of ornaments to frames is simple and labor efficient, for example, the number of parts is minimized and there is no requirement for special tools.

Contrary to the prior art, aspects of the present invention provide the fixture designer with the capability to position and orient ornaments, for example, octagonal crystals, in desired orientations to, for example, enhance the visual appearance of the ornament that heretofore was unavailable. For example, according to the prior art, ornaments such as crystal octagons are typically mounted by means of hooks or dangling ornament chains. The positioning and orienting of these prior art are, by their nature, subject to the forces of gravity. That is, the force of gravity may compete with the desired orientation of the ornament, for example, to effect a desired visual effect, and restrict the designer to certain accepted ornament positions and orientations. However, according to aspects of the invention, the limiting effects of gravity may can be overcome by providing methods and devices that position and orient ornaments in a predefined orientation without the limitations imposed by gravity. According to aspects of the invention, ornaments, for example, perforated ornaments, may be mounted to enhance the visual appeal of the individual ornament or visual appeal of the arrangement of ornaments. According to one aspect of the present invention, this is achieved by the interaction of the mounting feature, be it a pin, post, or wire, and the internal surface of the aperture into which the ornament is mounted. In one aspect, the internal surface of the apertures and the post, pin, or wire interact to orient the ornaments in a predetermined orientation. As will be more apparent upon review of aspects of the invention below and the accompanying figures, this interaction, bearing, or contact between the ornament and the mounting device permits the ornament fixture designer to position and orient crystal ornaments in a fashion that heretofore was unavailable.

One aspect of the present invention is an arrangement for mounting a decorative ornament including a frame having an aperture, the aperture having an internal surface; and at least one mounting post projecting from the frame, the mounting post adapted for insertion through a perforation in the ornament; wherein the ornament is retained by the mounting post and the internal surface of the aperture when the ornament is mounted to the mounting post. In one aspect of the invention, the mounting post is flexible and adapted for deflection from a first position to a second position for mounting the ornament.

Another aspect of the invention is an arrangement for mounting a decorative ornament including a frame having an aperture, the aperture having an internal surface; and means for mounting the ornament to the frame, the means adapted to engage a perforation in the ornament; wherein the ornament is retained by the means for mounting and by the internal surface of the aperture when the ornament is mounted to the frame. The means for mounting the ornament may include at least one mounting post projecting from the frame, for example, a pin or wire mounted, for example, integral with the frame.

Another aspect of the invention is a method for mounting a decorative ornament to a frame having an aperture and a flexible mounting post, the aperture having an internal surface, the method including the steps of deflecting the mounting post from a first position to a second position; mounting the ornament on the mounting post in the second position; deflecting the mounting post having the ornament to the first position; and retaining the ornament in the aperture by means of the mounting post and the internal surface of the aperture. In one aspect of the invention, the aperture defines a plane or surface, wherein in the first position the mounting post is substantially parallel to the plane or surface and in the second position the mounting post is substantially non-parallel to the plane or surface.

A further aspect of the invention is an ornamental fixture including a frame having at least one aperture, the at least one aperture having an internal surface; and at least one mounting post projecting from the frame, the mounting post adapted for insertion through a perforation in the ornament; wherein the ornament is retained by the at least one mounting post and the internal surface of the at least one aperture when the ornament is mounted to the at least one mounting post. In one aspect of the invention, the ornamental fixture is an ornamental light fixture, for example, a lamp or chandelier.

Another aspect of the invention is an ornamental fixture including a frame having at least one aperture, the at least one aperture having an internal surface; and means for mounting the ornament to the frame, the means adapted to engage a perforation in the ornament; wherein the ornament is retained by the means for mounting the ornament to the frame and the internal surface of the at least one aperture when the ornament is mounted to the frame. In one aspect, the means for mounting the ornament may be at least one mounting post projecting from the frame, for example, at least one pin or wire.

A still further aspect of the invention is an arrangement for mounting a decorative ornament having an axis and a mounting hole that does not pass through the center of gravity of the ornament, the arrangement including a frame having a surface and the frame having an aperture having an internal surface; and at least one mounting post projecting from the frame, the mounting post adapted for insertion through the mounting hole of the ornament; wherein when the ornament is mounted to the mounting post, the axis of the ornament makes an angle greater than 0 degrees with the vertical.

A further aspect of the invention is an arrangement for mounting decorative ornaments, each ornament having at least one perforation, the arrangement including: a frame having a plurality of apertures, the apertures having an internal surface; and at least one wire adapted for insertion through the perforations of a plurality of the ornaments; wherein the ornaments are retained by the at least one wire and the at least one internal surface of the aperture when the ornaments are mounted to the wire.

Another aspect of the invention is a method for mounting a plurality of perforated decorative ornaments to a frame having a plurality of apertures, the apertures having an internal surface, the method including positioning the plurality of ornaments in the plurality of apertures on a first side of the frame wherein the ornament perforations are accessible from the second side of the frame, opposite the first side; passing at least one wire through a plurality of the ornament perforations on the second side of the frame; and retaining the plurality of ornaments in the apertures by means of the at least one wire and the internal surface of the apertures.

A still further aspect of the invention is a fixture for mounting perforated ornaments, the fixture including a frame having a plurality of apertures, the plurality of apertures having internal surfaces; and at least one wire adapted for insertion through the perforations of the perforated ornaments; wherein the ornaments are retained by the at least one wire and the internal surfaces of the apertures when the ornaments are positioned in the apertures and the at least one wire is inserted through the perforations.

A further aspect of the invention is a light fixture having decorative ornaments, the light fixture including a frame having a plurality of apertures; a plurality of ornaments mounted in the plurality of apertures; means for mounting the plurality of ornaments to the frame; a light adapted to illuminate at least some of the plurality of ornaments. In one aspect, the frame may be a cylindrical frame. In another aspect, the frame may be a planar frame suspended from the light fixture, for example, by one or more chains or posts.

A further aspect of the invention is a method for mounting a plurality of perforated decorative ornaments to a frame having a plurality of apertures, the apertures having an internal surface, the method including mounting a plurality of wires to the frame wherein each wire projects over at least one of the plurality of apertures; mounting at least one of the perforated decorative ornaments to at least one of the plurality of wires by means of a perforation; and retaining at least one of the perforated decorative ornaments in at least one of the apertures by means of the at least one wire and at least one of the internal surfaces of the apertures.

Thus, aspects of the present invention provide for improved arrangements and methods for mounting ornaments to and to ornamental fixtures, for example, ornamental lighting fixtures.

BRIEF DESCRIPTION OF THE FIGURES

The subject matter that is regarded as the invention is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF FIGURES

Figure 1:
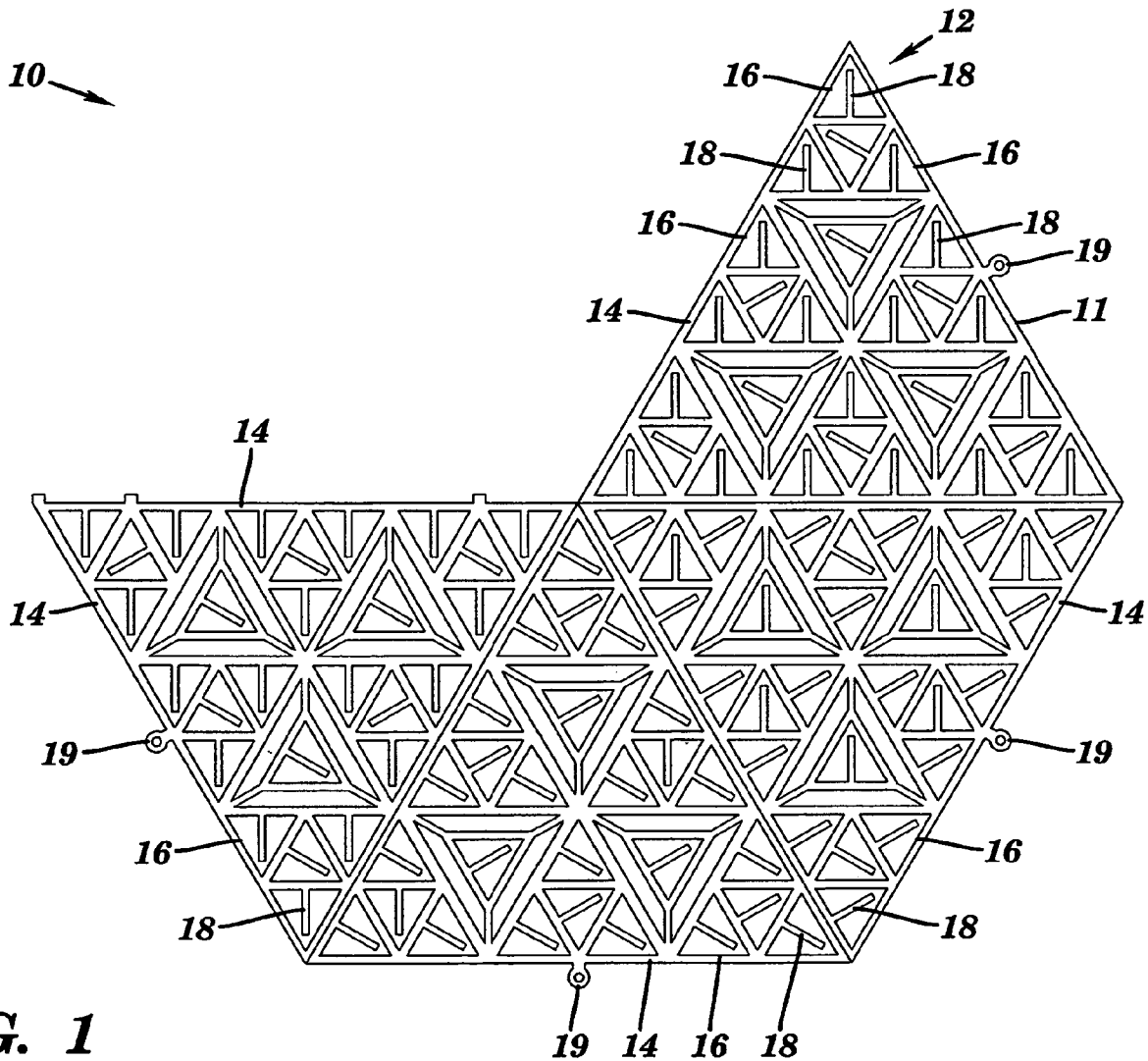
FIG. 1 is a plan view of an ornament retaining frame having ornament retaining arrangements according to one aspect of the present invention.

The details and scope of aspects of the present invention can best be understood upon review of the attached figures and their following descriptions. FIG. 1 is a plan view of an ornament retaining fixture 10 comprising a frame 11 and ornament retaining arrangements 12 according to one aspect of the present invention. In the aspect of the invention shown, frame 11 comprises a plurality of individual triangular perforated frame panels 14. According to this aspect of the invention, frame 11 is illustrated in a pre-assembled state, that is, prior to the assembly of frame panels 14 into a polygonal shape, for example, the triangular-shaped ornamental fixture shown in FIGS. 7A and 7B. According to the presenting invention, frame 11 includes a plurality ornament retaining arrangements 12 having apertures 16 with each aperture 16 having one or more mounting pins or posts 18 for mounting ornaments. Frame 11 may also include means 19 for hanging fixture 10, for example, eyelets, hooks, or other conventional structures for hanging fixture 10.

Figure 2:
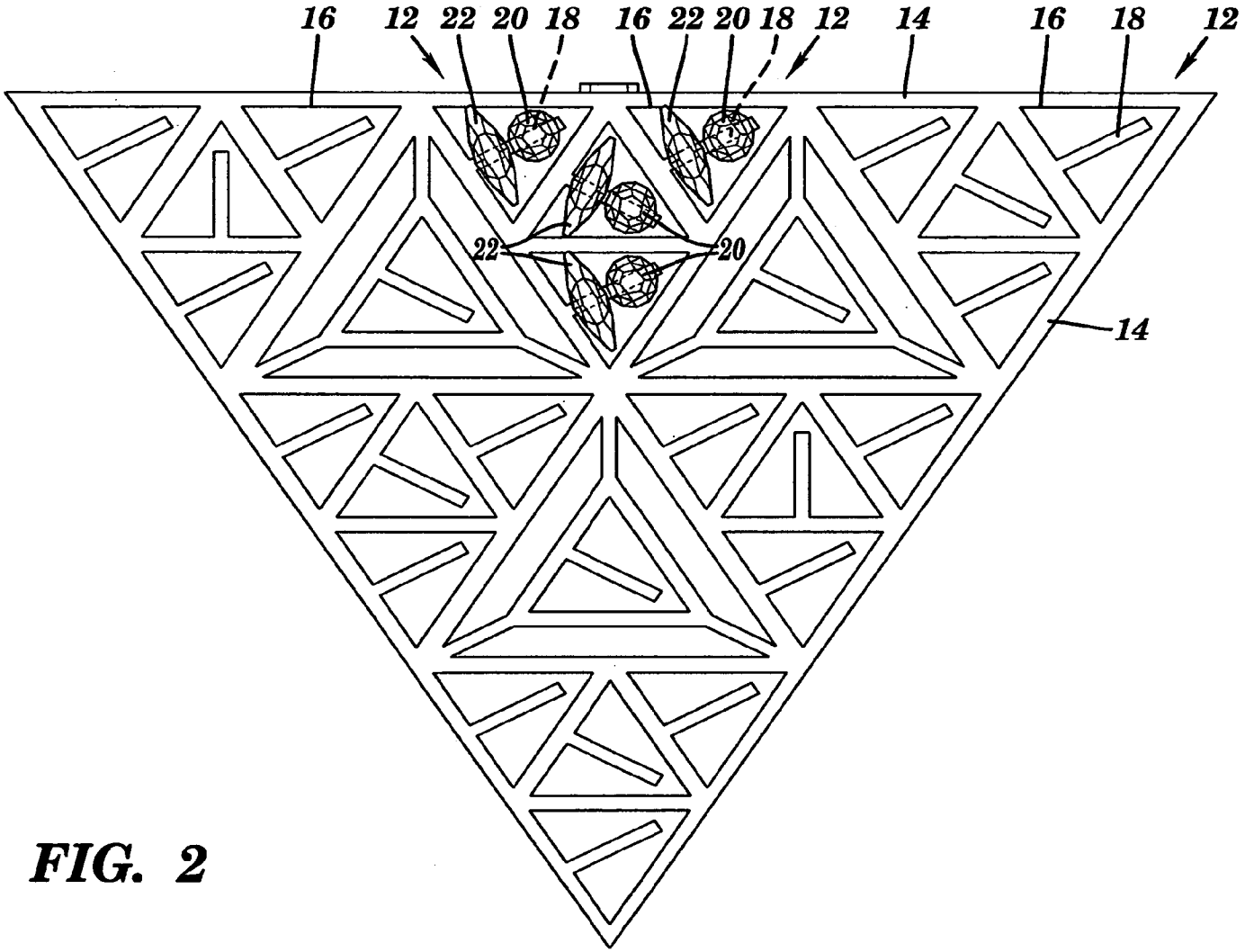
FIG. 2 is a plan view of a plurality of ornaments mounted in a frame panel shown in FIG. 1 according to one aspect of the present invention.

FIG. 2 illustrates a plan view of one frame panel 14 having a plurality of ornaments 20, 22 mounted therein on mounting pins 18 according to one aspect of the present invention. For clarity of illustration, only a representative set of ornaments 20, 22 are shown in FIG. 2. According to this aspect of the invention, ornaments 20, 22 may comprise perforated ornaments, that is, ornaments having a through hole. Ornaments 20, 22 may be perforated beads or crystals, for example, multifaceted octagonal beads or multifaceted spherical beads. According to one aspect of the invention, ornaments 20, 22, and all ornaments discussed herein, may comprise any type of perforated bead, stone, crystal, or the like that may be used in decorative fixtures. For example, according to one aspect of the invention ornaments 20, 22 may comprise any type of faceted or non-faceted (that is, smooth) shape, for example, spheres, cubes, cones, bars, tubes, rods, prisms, and the like. Ornaments 20, 22 may be made from glass, plastic, metal, stone, or any other conventional material from which ornamental beads are typically made. Ornaments 20, 22 may also comprise perforated gems, for example, diamonds, rubies, sapphires, opals, and the like. Ornaments 20, 22 may be made from a transparent, translucent, or opaque material, for example, colored glass. In one aspect of the invention, ornaments 20, 22 may also comprise illuminated ornaments, such as, lights or light-emitting diodes (LEDs).

According to one aspect of the invention, frame 11 may be made from any conventional material, for example, any conventional metallic or non-metallic plate or sheet material. In one aspect of the invention, frame 11 may be made from a metal plate or sheet, for example, iron, steel, stainless steel, aluminum, titanium, nickel, magnesium, copper, silver, gold, or any other metal conventionally used in ornamental fixtures. In one aspect of the invention frame 10 may be made from plastic, for example, polyethylene (PE), polypropylene (PP), polyester (PE), polytetraflouroethylene (PTFE), or acrylonitrile butadiene styrene (ABS), among other plastics. In one aspect of the invention, frame 11 may be made from a material that is transparent, translucent, or opaque. In one aspect of the invention, frame 11 comprises a flexible material, for example, a flexible material capable of undergoing elastic or plastic deformation or deflection. In one aspect of the invention, frame 11 is fabricated from a plate or sheet having a thickness of between about 0.010 inches and about 0.5 inches, for example, between about 0.020 inches and about 0.25 inches, typically, between about 0.020 inches and about 0.050 inches. According to aspects of the invention, frame 11 (and other frames disclosed herein) may comprise an essentially flat plate or frame as shown in FIG. 2 that can be formed in to a multitude of faceted three dimensional shapes, for example, pyramids and polyhedra. However, in other aspects of the invention, frame 11 (and other frames disclosed herein) may also be not flat or non-planar, for example, frame 11 may be curved, for example, to provide a cylindrical frame, or a variety of three dimensional shapes, for example, a sphere (for instance, a faceted sphere), a pyramid, various polyhedrons, and any other conventional three-dimensional shape.

Figure 3:
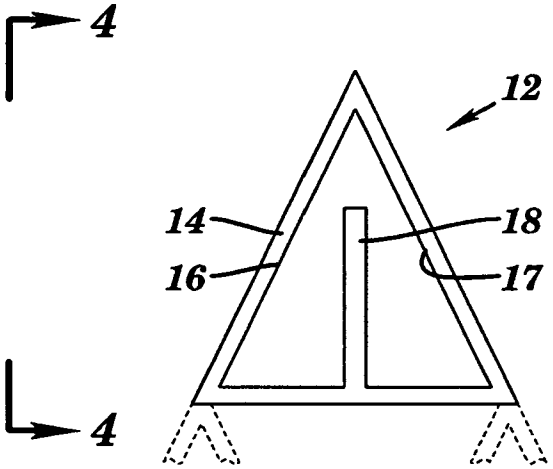
FIG. 3 is a detailed view of the ornament retaining arrangement shown in FIGS. 1 and 2.

FIG. 3 illustrates a detailed plan view of mounting arrangement 12 shown in FIGS. 1 and 2. According to this aspect of the invention, arrangement 12 includes a triangular aperture 16 in frame 11 and at least one mounting post or pin 18 affixed to frame 11 and projecting into aperture 16. In the aspect of the invention shown in FIG. 3, aperture 16 is triangular in shape; however, according to one aspect of the invention, aperture 16 may comprise any shaped hole, slot, or cut-out in frame 11, for example, a circular, ellipsoidal, triangular, square, rectangular, or any polygonal-shaped aperture, among others. In one aspect of the invention, aperture 16 comprises a closed shape, that is, a shape having a continuous uninterrupted internal surface 17. In another aspect of the invention, aperture 16 may be an open shape, that is, a shape have internal surface 17 that is discontinuous or interrupted.

The cross-section of mounting post 18 may take any appropriate shape. Mounting post 18 may be circular, ellipsoidal, rectangular, square, or polygonal shape. In one aspect of the invention, mounting post 18 may be polygonal in shape, for example, rectangular, but have rounded corners that result from the method of fabrication, for example, the rounded corners typically encountered on punched or die-pressed shapes. Mounting post 18 may have a thickness (for example, diameter) that is larger or smaller than the thickness of frame 11, though in one aspect of the invention, the thickness of mounting post 18 is about equal in the thickness of frame 11, for instance, mounting post 18 is fabricated from the same plate or sheet material as frame 11.

As shown in FIG. 3, in one aspect of the invention mounting post 18 may be mounted to frame 11 whereby mounting post 18 projects into aperture 16. In one aspect of the invention, mounting post 18 may be mounted to frame 11 whereby mounting post 18 is substantially perpendicular to an internal surface 17 of aperture 16. In one aspect of the invention, mounting post 18 may be mounted to frame 11 whereby mounting post 18 is substantially non-perpendicular to an internal surface 17 of aperture 16. Mounting post 18 may be mounted integrally with the internal surface 17 of aperture 16 wherein the upper surface of mounting post 18 is substantially coplanar with the upper surface of frame 11, for example, when mounting post 18 and frame 11 are fabricated from the same material, for example, cut, die cut, or punched from the same material, that is, from the same sheet or plate. In one aspect of the invention, at least one of aperture 16 and mounting post 18 may be fabricated by laser cutting, water-jet cutting, electro-discharge machining (EDM), for example, wire-EDM, among other conventional fabrication methods. In one aspect of the invention, cutting of one of aperture 16 and post 18 may practiced with the aid of a computer control. In one aspect of the invention, at least one of aperture 16 and mounting post 18 may be fabricated by lithographic methods, for example, photolithographic methods.

In another aspect of the invention, mounting post 16 may be mounted on the upper surface of frame 11 or the lower surface of frame 11, whereby mounting post 18 projects above or below aperture 16, for example, when aperture 16 is produced by drilling, punching, or any of the cutting methods referenced above. In one aspect of the invention, mounting post 18 may be mounted above the upper surface of frame 11 or below the lower surface of frame 11 and project into aperture 16 at an oblique angle, for example, non-parallel to either the upper or the lower surface of frame 11. In one aspect of the invention, mounting post 18 may be mounted to frame 11 by any conventional means, for example, by means of welding (for example, resistance welding), brazing, with an adhesive, or by means of mechanical fasteners.

Figure 4:
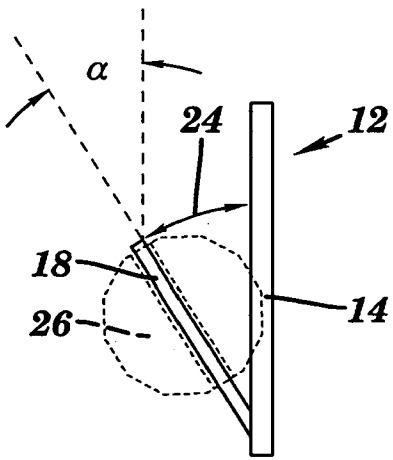
FIG. 4 is a side view of the ornament retaining arrangement shown in FIG. 3 as viewed along view-lines 4-4 with the mounting post deflected.

FIG. 4 is a side view of the ornament retaining arrangement 12 shown in FIG. 3 as viewed along view lines 4-4. FIG. 4 illustrates one aspect of the invention in which mounting post 18 may be deflected to a second position, for example, as shown by double arrow 24, for mounting one or more perforated ornaments 26 (shown in phantom) onto mounting post 18. For example, in one aspect of the invention, mounting post 18 may be deflected, either manually or automatedly, as shown by double arrow 24 from a first position substantially parallel to the plane of frame 11 to a second position substantially non-parallel to the plane of frame 11. For example, in one aspect of the invention, mounting post 18 may be deflected an angle $\alpha$ of at least 5 degrees from the horizontal, for example, at least 15 degrees or at least 30 degrees from the horizontal, whereby ornament 26 may be mounted to mounting post 18. In one aspect of the invention, aperture 16 defines a plane and angle $\alpha$ is measured relative to the plane defined by aperture 16, for example, relative to a plane defined by the upper edge, lower edge, or mid-plane of aperture 16. Again, mounting post 18 may be deflected an angle $\alpha$ of at least 5 degrees from the plane defined by aperture 16, for example, at least 15 degrees or at least 30 degrees.

The mounting of ornament 26 on mounting post 18 may be effected by simply sliding the perforation (or through hole) of the ornament over the mounting post 18. According to the present invention, the deflection of mounting post 18 and the mounting of one or more ornaments 26 on mounting post 18 may be practiced manually or by automated means, for example, by means of a robotic actuator. In one aspect of the invention, ornament 26 may be mounted to post 18 with the aid of an adhesive. In another aspect of the invention, before or after mounting ornament 26 on post 18, post 18 may be deformed, for example, mechanically bent or kinked, to provide an obstruction that assists in retaining ornament 26 on post 18. In one aspect of the invention, the angle of deflection a may be dependent upon the size of ornament 26 and angle $\alpha$ must be sufficient to allow the mounting of ornament 26 on mounting post 18, for example, without interference from frame 11.

According to the present invention, the deflection of mounting post 18 may comprise elastic deflection, where mounting post 18 elastically returns from the second, deflected, position to essentially the first, non-deflected, position without the application of external force. The deflection of mounting post 18 may also comprise plastic deflection where mounting post 18 retains the second, deflected, position and must be forcibly returned to the first, non-deflected, position.

Figure 5:
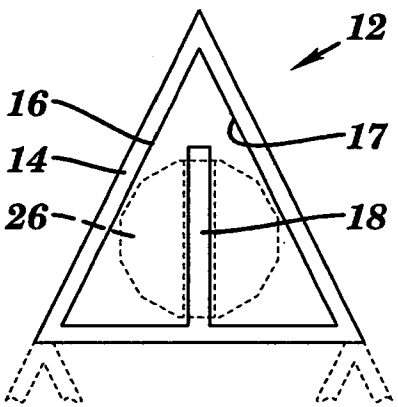
FIG. 5 is a detailed view similar to FIG. 3 showing the mounting of a representative ornament (in phantom.)

FIG. 5 is another detailed view similar to FIG. 3 showing the mounting of the representative ornament 26 (in phantom) in aperture 16 after mounting post 18 is returned to the first, non-deflected, position after the mounting of ornament 26. As shown in FIG. 5, ornament 26, which may be one or more ornaments, is retained in aperture 16 by mounting post 18 and the internal surfaces 17 of aperture 16. Specifically, the mounting of perforated ornament 26 on mounting post 18 prevents ornament 26 from moving perpendicular to the plane of FIG. 5, the bottom surface of aperture 16 prevents ornament 26 from moving downward in the plane of FIG. 5, and the two angled internal surfaces 17 of aperture 16 prevent ornament 26 from slipping off the end of mounting post 18. As a result, this aspect of the present invention provides an effective arrangement and method for mounting and retaining one or more ornaments in a frame of an ornamental fixture, for example, a chandelier, which are characterized by ease of fabrication and ease of assembly, for instance, without the need for additional mounting hardware or the need for special tools.

Figure 6:
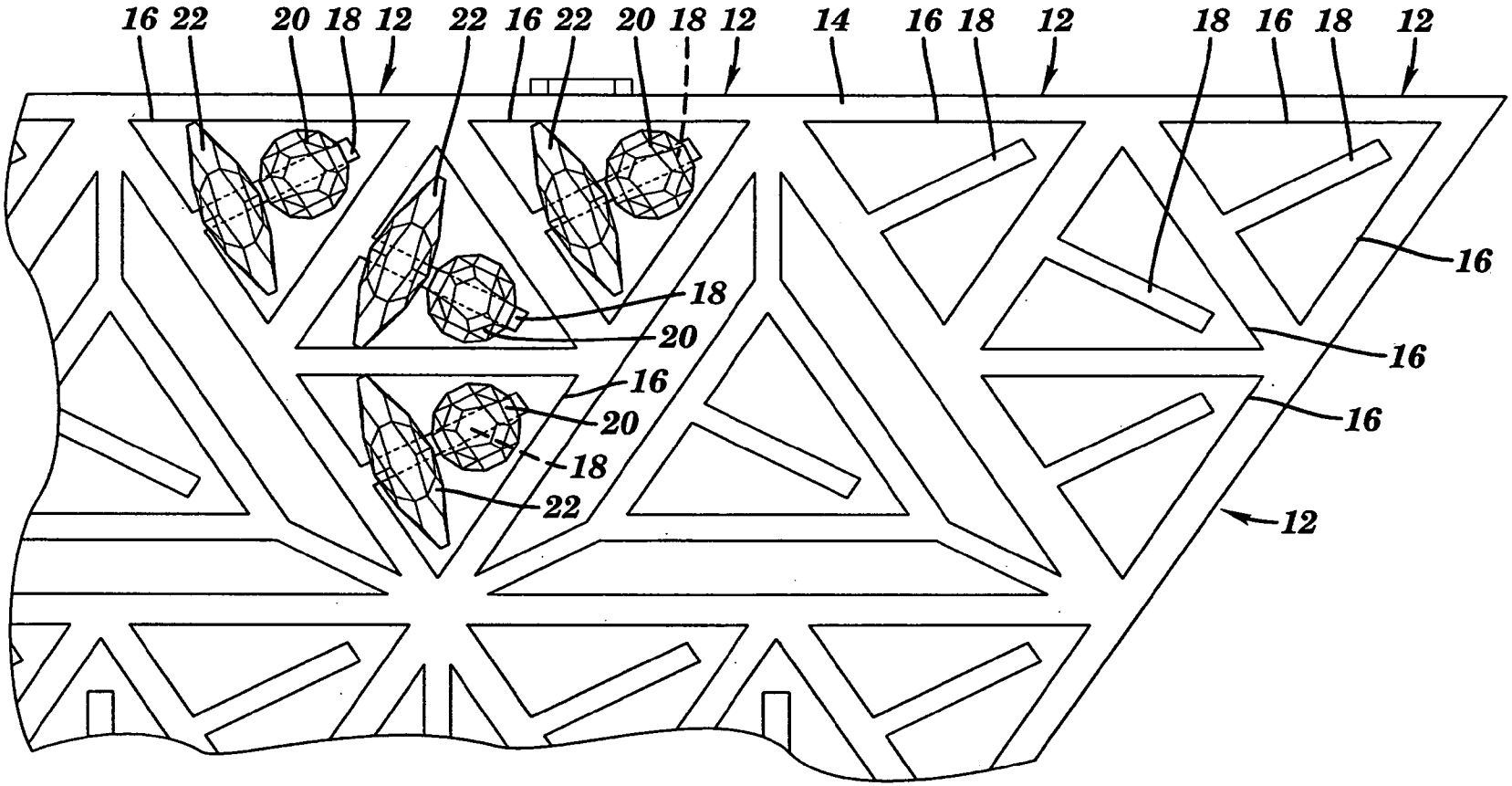
FIG. 6 is a detailed view of the mounting arrangement shown in FIG. 5.

FIG. 6 is a detailed view of frame 11 shown in FIG. 1 and mounting arrangement 12 shown in FIG. 2 assembled as described with respect to FIGS. 3 through 5. In the aspect of the invention shown in FIG. 6, a representative section of frame panel 14 of frame 11 showing four (4) mounting arrangements 12 having ornaments 20, 22 is shown. Each mounting arrangement 12 comprises a triangular aperture 16, a mounting post 18, and two ornaments 20, 22 mounted on each mounting post 18. In this aspect of the invention, ornament 20 comprises a multifaceted, spherical crystal bead and ornament 22 comprises a multifaceted, octagonal crystal jewel. Spherical bead 20 includes a through hole directed substantially along the axis of bead 20. Octagonal crystal jewel 22 includes a through hole that is not directed along the axis of jewel 22, but is off-set from the axis of the jewel, but substantially parallel to the axis of jewel 22. Mounting arrangement 12 may be used alone or with multiple similar or different arrangements in an ornamental fixture, for example, ornamental light fixture, for instance, a chandelier, lamp, or wall sconce.

Figure 7A:
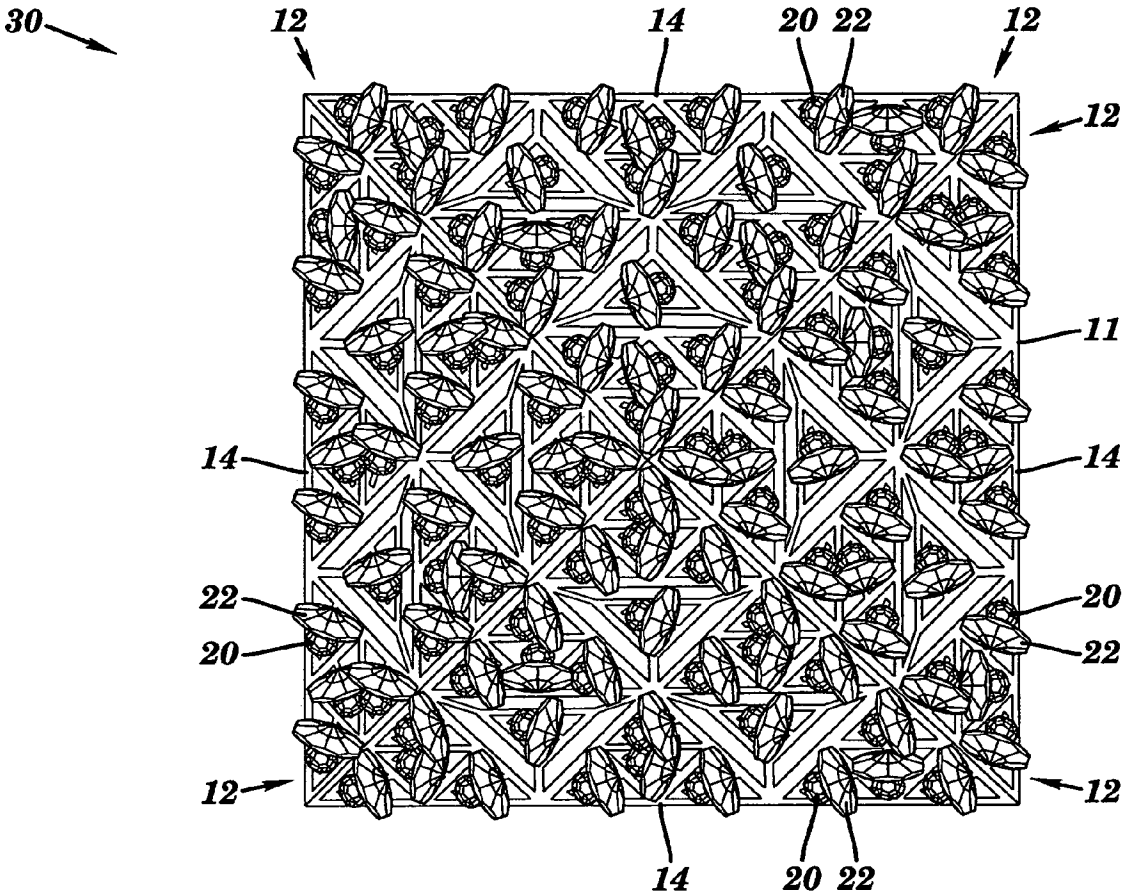
FIGS. 7A and 7B are a bottom view and a side view, respectively, of an ornamental fixture according to one aspect of the present invention.
Figure 7B:
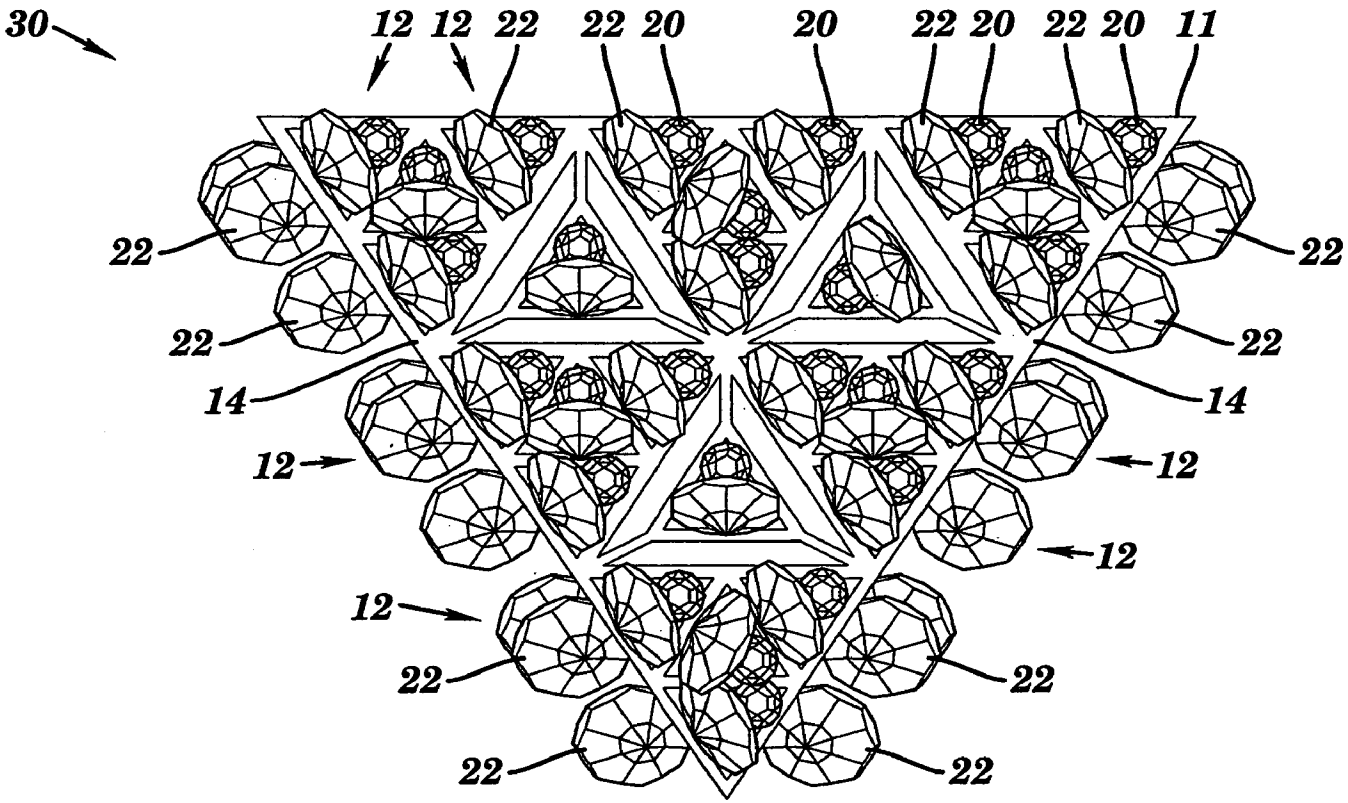

FIGS. 7A and 7B represent a bottom view and a side view, respectively, of an assembled ornamental fixture 30 comprising frame 11, panels 14, and mounting arrangements 12 having beads 20 and jewels 22 as described with respect to FIGS. 1 through 6. According to this aspect of the invention, the four (4) frame panels 14 shown in FIG. 1 have had beads 20 and jewels 22 mounted in mounting arrangement 12 as described in FIGS. 3 through 5. The unassembled, flat frame 11 shown in FIG. 1 was then folded or bent along the dividing lines of the panels 14 to provide the pyramidal structure shown in FIGS. 7A and 7B. As characterized by aspects of the present invention, in FIGS. 7A and 7B, beads 20 and jewels 22 are mounted and retained by mounting arrangement 12 without the need for additional mounting hardware or adhesives. Beads 20 and jewels 22 are simply retained by mounting pins 18 and the internal surfaces of apertures 16. Ornamental fixture 30 may be used alone or with multiple similar or different fixtures in an ornamental fixture, for example, ornamental light fixtures, for instance, a chandelier, lamp, or wall sconce.

Figure 8:
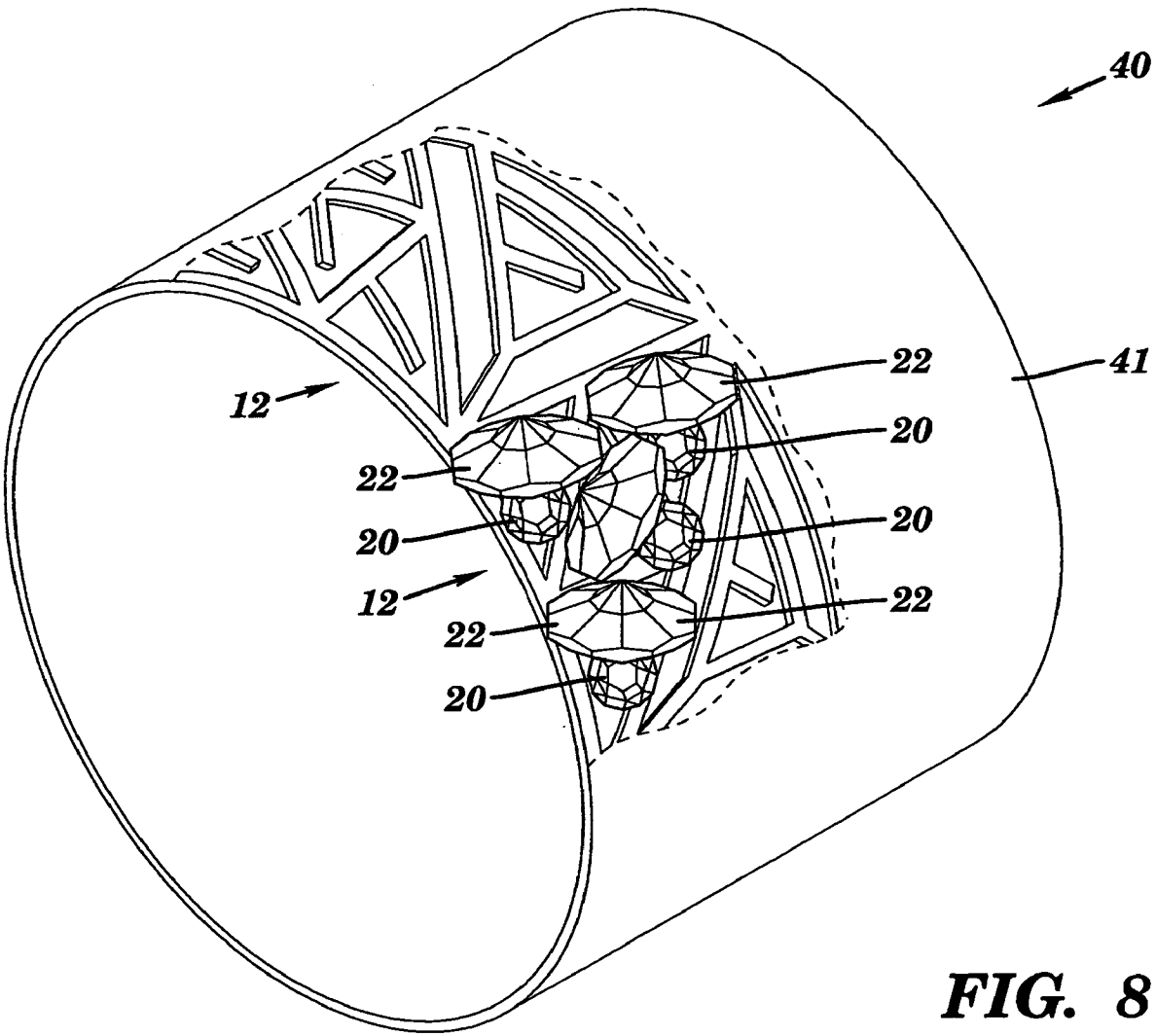
FIG. 8 is a perspective view of another ornamental fixture according to one aspect of the present invention.

FIG. 8 is a perspective view of another ornamental fixture 40 according to one aspect of the present invention. In this aspect of the invention, ornamental fixture 40 comprises a cylindrical frame 41 having mounting arrangements 12 which retain beads 20 and jewels 22 as described with respect to FIGS. 1 through 6. In this aspect of the invention, cylindrical frame 41 was produced by rolling the flat frame 11 shown in FIG. 1. For the sake of clarity, only a representative portion of cylindrical frame 41 having representative beads 20 and jewels 22 is shown in FIG. 8. Ornamental fixture 40 may be used alone or with multiple similar or different fixtures in an ornamental fixture, for example, ornamental light fixtures, for instance, a chandelier, lamp, or wall sconce.

FIGS. 7A, 7B, and 8 illustrate another aspect of the invention that is not found in the prior art. Some of the ornaments illustrated in these figures, for example, octagonal crystal jewels 22 in FIGS. 7A, 7B, and 8, are ornaments having perforations that do not pass through the center of the ornament, that is, the location of the center of gravity of these types of ornaments are offset from the location of the through hole by which the ornament is mounted to mounting post 18. According to the prior art, the orientation of such ornaments, for example, pendalogs or pear-shaped pendants, when mounted to a frame is typically governed by gravity. Such ornaments typically are oriented whereby their axes are directed downward due to gravity acting at their centers of gravity. According to the prior art, any other type of non-vertical orientation typically requires the use of complex and expensive brackets, hooks, or other attachments to orient the ornament in a non-vertical direction. According to one aspect of the present invention, mounting arrangements are provided whereby such ornaments can be mounted in any desired orientation without the need for any type of additional mounting hardware. The various orientations octagonal crystal jewels 22 shown in FIGS. 7A, 7B, and 8 are examples of just some of the non-conventional, non-vertical crystal orientations that are provided by the present invention. The general features of this aspect of the invention are illustrated in FIG. 11.

Figure 11:
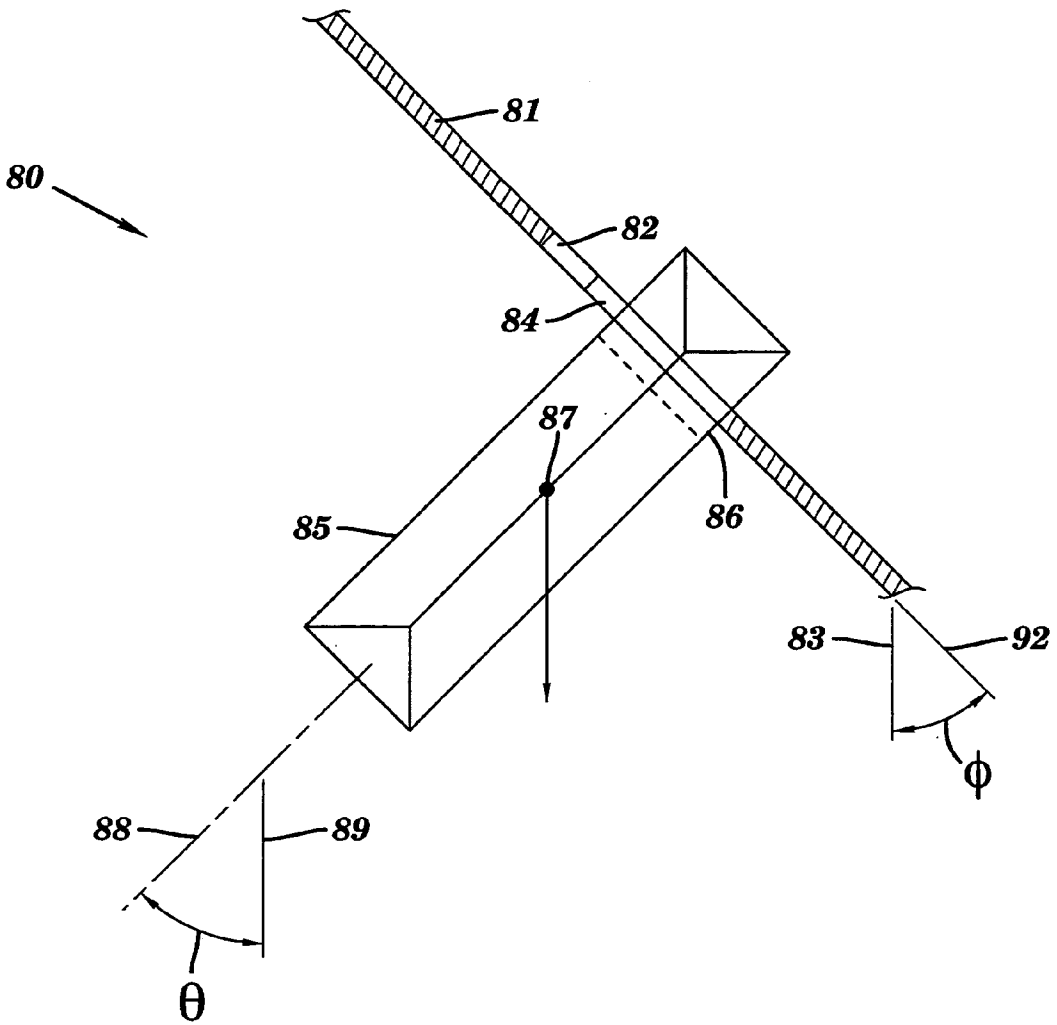
FIG. 11 illustrates another aspect of the present invention that provides oriented mounting of ornaments.

FIG. 11 illustrates another mounting arrangement or fixture 80 according to another aspect of the present invention in which the orientation of the mounting of one or more ornaments can be varied with little or no influence from gravity. FIG. 11 shows a representative cross section of a mounting frame 81, for example, a frame similar to frame 11 discussed above. In this aspect of the invention, the surface, identified by dotted line 92, of frame 81 is oriented at an angle $\phi$ to the vertical, represented by dotted line 83. Frame 81 includes at least one aperture 82 (for example, a triangular aperture as shown in FIGS. 1 through 6) having at least one mounting post 84, for example, a mounting post similar to mounting post 18 discussed above. As shown in FIG. 11, an ornament 85 having through hole 86 (shown in phantom) is mounted to mounting pin or post 84 in a manner typical of the mounting arrangements described above, that is, mounting post 84 may be deflected to mount ornament 85. According to this aspect of the invention, ornament 85 has a center of gravity identified by point 87 and an axis 88 that is oriented at an angle $\theta$ to the vertical, as represented by dotted line 89. According to this aspect of the invention, through hole 86 of ornament 85 may not pass through center of gravity 87, however, according to the present invention, the orientation of axis 88 is not vertical, as would be dictated by gravity and the conventional art. For example, according to the prior art, since through hole 86 does not pass through center of gravity 87, a bending moment is produced in ornament 85 that attempts to orient ornament 85 in a vertical direction, for example, whereby angle $\theta$ is substantially zero. However, according to this aspect of the present invention, the bending moment caused by the offset of through hole 86 from center of gravity 87 is resisted by contact between ornament 85 and at least mounting post 84 and, in one aspect, the internal surfaces of aperture 82.

According to this aspect of the present invention, the axis of ornament 85 may be oriented in any desired direction. For example, in one aspect of the invention, ornament 85 may be mounted to mounting post 84 whereby angle $\theta$ is about equal to angle $\phi$, for instance, if angle $\phi$ is about 45 degrees, angle $\theta$ may be about 45 degrees. In another aspect of the invention, angle $\theta$ may vary from angle $\phi$. For example, in this aspect of the invention, the orientation of mounting post 84, which in the prior aspects of the invention is shown substantially oriented parallel to the surface of frame 81, may vary from being parallel to the surface of frame 81. For example, mounting post 84 may have an angle that varies from the angle of orientation of surface 92, that is, varies from angle $\phi$. The variation of the orientation of ornament 85 may also be defined or assisted by the geometry of the internal surfaces of aperture 82. In one aspect of the invention, the orientation of mounting post 84 relative to the vertical may be about equal to angle $\theta$, for example, when through hole 86 is substantially perpendicular to axis 88. In another aspect of the invention, through hole 86 may not be substantially perpendicular to axis 88 and angle $\theta$ may vary from the angle of orientation of mounting post 84. Other geometric configurations of the angle of mounting post 84 and angles $\theta$ and $\phi$ will be apparent to those familiar with the art. According to one aspect of the invention surface 82 may be a planar surface, as shown in FIGS. 7A and 7B, or a curved surface, as shown in FIG. 8.

Figure 9:
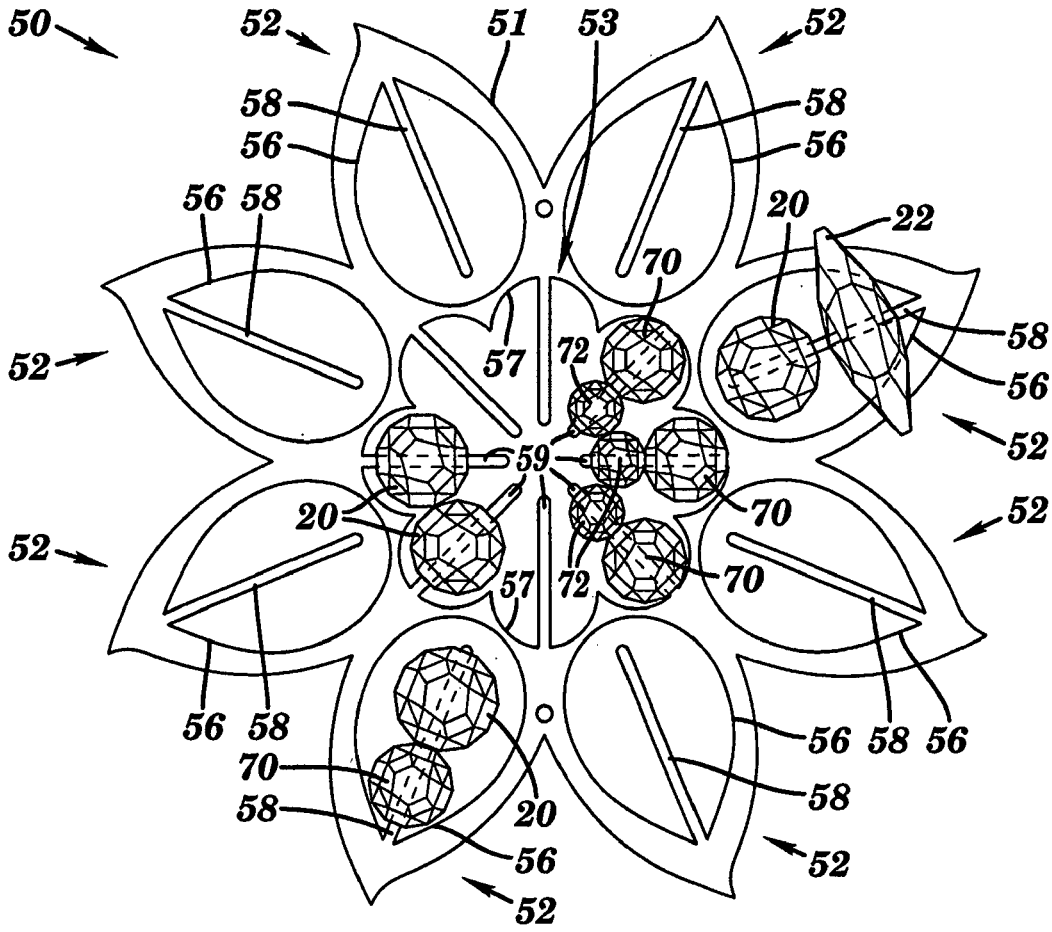
FIG. 9 is a plan view of a mounting arrangement according to another aspect of the invention.

FIG. 9 is a plan view of an ornament mounting arrangement or fixture 50 according to another aspect of the invention. In this aspect of the invention, mounting arrangement 50 comprises a frame 51 (for example, a planar frame having the properties described above for frame 11) and having leaf-shaped mounting arrangements 52 and 53. According to this aspect of the invention, mounting arrangement 52 includes a floral-like aperture 56 and a mounting post 58 and mounting arrangement 53 includes a floral-like aperture 57 and a plurality of mounting posts 59. A representative ornamental bead 20 and jewel 22 are shown mounted in mounting arrangement 52 and representative beads 20 are shown mounted in mounting arrangement 53. Also, representative beads 20 and 70 are also shown mounted in mounting arrangement 52; in this example, bead 70 is smaller than bead 20. In addition, multiple representative beads 70 and 72 are shown mounted in mounting arrangement 53; in this example, bead 72 is smaller than bead 70. According to this aspect of the invention, beads 20, 70, and 72 and jewels 22 may be mounted to mounting posts 58 and 59 in a fashion similar to the mounting of ornaments on mounting post 18 shown in FIGS. 3 through 5. That is, ornaments 20, 22, 70, and 72 may be mounted in arrangements 52 and 53 by deflecting posts 58 and 59 from the first position shown to a second position and then returning posts 58 and 59 to the first position as shown in FIG. 9. As is characteristic of aspects of the present invention, ornaments 20, 22, 70, and 72 are then retained in mounting arrangements 52 and 53 by respective posts 58 and 59 and the respective internal surfaces of apertures 56 and 57. In one aspect of the invention, ornaments may also be retained in mounting arrangement 50 due to contact with other ornaments. For example, as shown in mounting arrangement 53 in FIG. 9, ornaments 20 and 72 mounted on mounting pins 59 may also be retained on pins 59 due to contact with adjacent ornaments 20, 72. Also, as shown in FIG. 9, ornament 20 in mounting arrangement 53 may be retained on pins 59 due to contact with one or more adjacent ornaments 20. In one aspect of the invention, ornaments 20, 22, 70, and 72 may be retained by mounting posts 58 and/or 59, the internal surfaces of apertures 56 and/or 57, and one or more adjacent ornaments. In another aspect of the invention, ornaments 20, 22, 70, and 72 may be retained by mounting posts 58 and/or 59 and one or more adjacent ornaments, that is, only by one or more adjacent ornaments without the use of the internal surfaces of apertures 56 or 57. Ornament mounting arrangement 50 may be used alone or with multiple similar or different arrangements in an ornamental fixture, for example, ornamental light fixtures, for instance, a chandelier, lamp, or wall sconce.

Figure 10:
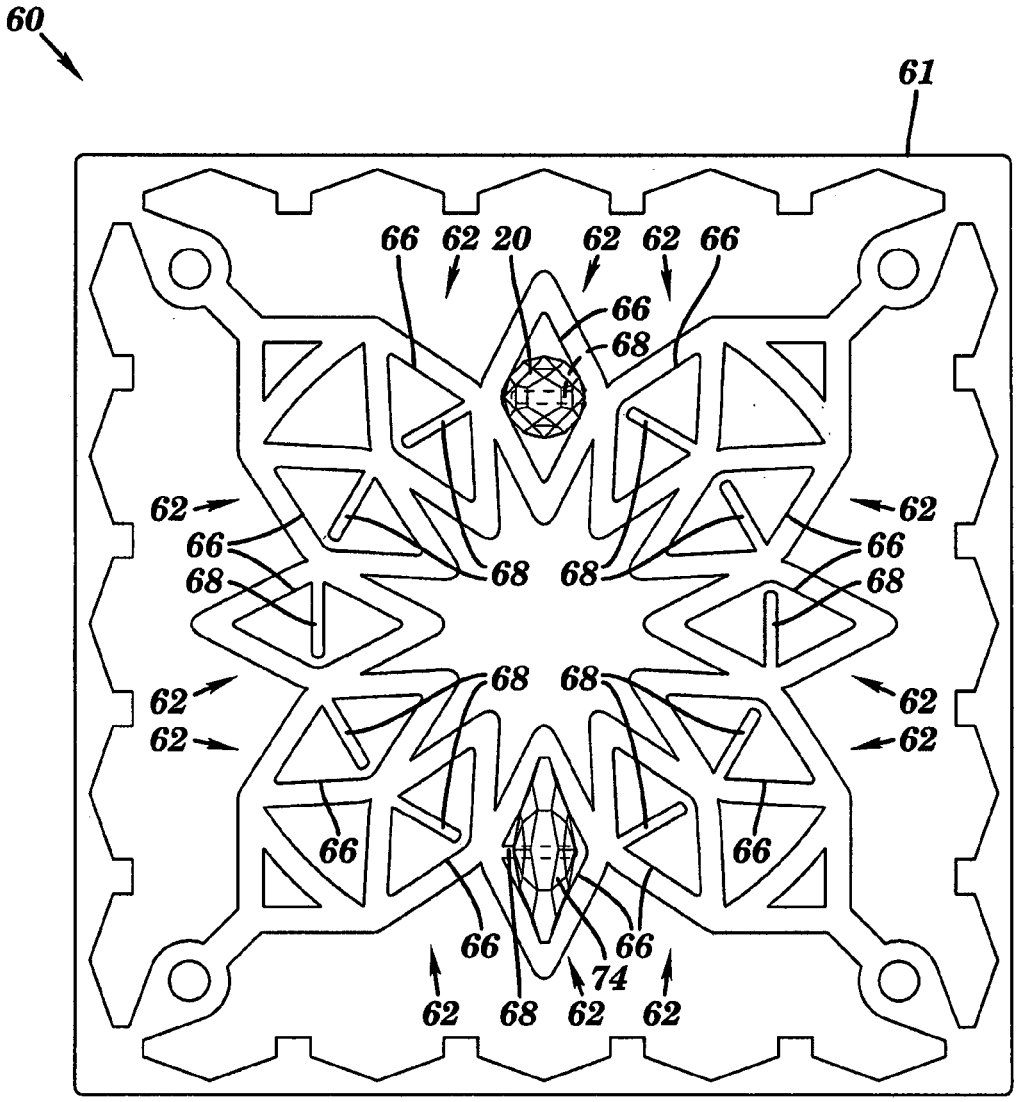
FIG. 10 is a plan view of a mounting arrangement according to still another aspect of the invention.

FIG. 10 is a plan view of another ornament mounting arrangement or fixture 60 according to another aspect of the invention. In this aspect of the invention, mounting arrangement 60 comprises a frame 61 (for example, a planar or circular frame having the properties described above for frame 11) and having a plurality of mounting arrangements 62. According to this aspect of the invention, each mounting arrangement 62 includes a diamond-shaped aperture 66 and a mounting post 68. Representative ornamental bead 20 and jewel 74 are shown mounted in two mounting arrangements 62. Again, according to this aspect of the invention, bead 20 and jewel 74 may be mounted to mounting pins or posts 68 in a fashion similar to the mounting of ornaments on mounting post 18 shown in FIGS. 3 through 5. In one aspect of the invention, jewel 74 is an ornament having a through hole that does not pass through the center of jewel 74, for example, jewel 74 may be an octagon crystal jewel similar to jewel 22 described previously, though other types of ornaments having off-center through holes may be used. As is characteristic of aspects of the present invention, ornaments 20 and 74 are retained in mounting arrangements 62 by posts 68 and the internal surfaces of apertures 66. Ornament mounting arrangement 60 may be used alone or with multiple similar or different arrangements in an ornamental fixture, for example, an ornamental light fixture, for instance, a chandelier, lamp, or wall sconce.

Figure 12:
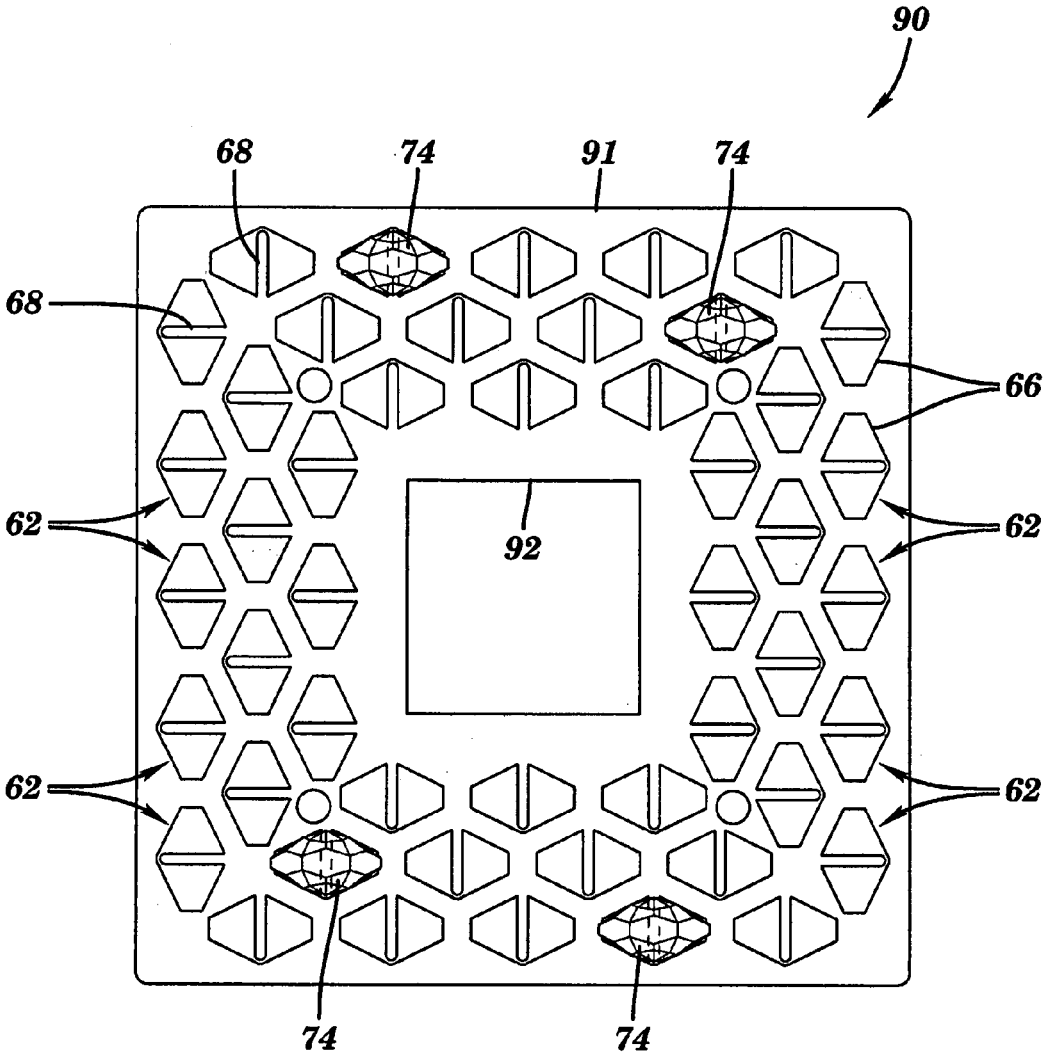
FIG. 12 illustrates another aspect of the present invention.

According to another aspect of the invention, mounting arrangement or fixture 62 shown in FIG. 10 may be incorporated into a mounting arrangement or fixture 90 as shown in FIG. 12. In this aspect of the invention, a plurality of mounting arrangements 62 in one or more rows in a frame 91 (for example, a planar or circular frame having the properties described above for frame 11) is provided. Each arrangement 62 includes apertures 66 (for example, diamond-shaped apertures) and mounting posts 68 as shown in FIG. 12. Frame 91 may be rectangular as shown, but any circular, oval, or polygonal shape may be used, and may include a central aperture 92, for example, a circular, square, or rectangular aperture. As described with respect to FIG. 10, mounting arrangements 62 may have any type of ornament mounted to mounting posts 68. In one aspect of the invention, a plurality of ornaments, for example, octagonal crystal jewels 74 (similar to jewel 74 shown in FIG. 10) may be mounted on mounting arrangements 62. Four representative jewels 74 are shown in FIG. 12, though typically most if not all of mounting arrangements 62 include a jewel 74. In one aspect of the invention, jewel 74 is an ornament having a through hole that does not pass through the center of jewel 74, for example, jewel 74 may be an octagon crystal jewel similar to jewel 22 described previously, though other types of ornaments having off-center through holes may be used. As is characteristic of aspects of the present invention, jewels 74 are retained in mounting arrangements 62 by posts 68 and the internal surfaces of apertures 66, for example, as shown in FIG. 11. Ornament mounting arrangement 90 may be used alone or with multiple similar or different arrangements in an ornamental fixture, for example, an ornamental light fixture, for instance, a chandelier, lamp, or wall sconce.

FIGS. 13 through 16 illustrate further aspects of the invention. These figures illustrate aspects of the present invention in which one or more ornaments may be retained to a frame or fixture by one or more wires engaging one or more ornaments. According to this aspect of the invention, though the term "wire" is used throughout to simplify the discussion, it will be understood by those of skill in the art, that the term wire may mean any filament-type member, for example, a metallic, non-metallic (for example, plastic) rod, wire, string, cord, or related element that can be used to function as shown and described.

Figure 14:
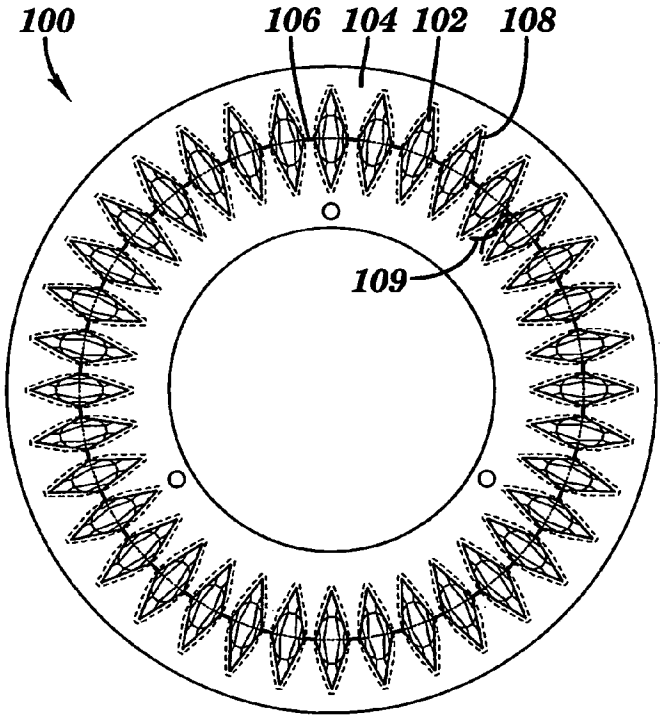
FIG. 14 is a rear plan view of the aspect of the invention shown in FIG. 13.
Figure 13:
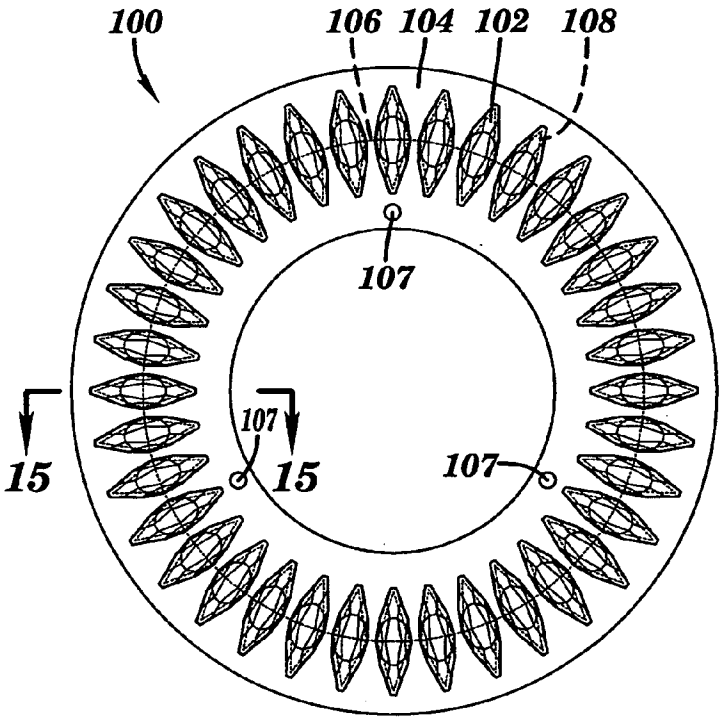
FIG. 13 a front plan view of another aspect of the invention.

FIG. 13 a front plan view of a mounting arrangement or fixture 100 according to an aspect of the invention. FIG. 14 is a rear plan view of arrangement 100 shown in FIG. 13. In this aspect of the invention, arrangement 100 includes one or more ornaments 102 mounted to a frame 104 by means of one or more wires 106. In one aspect of the invention, one or more wires 106 may be adapted to engage a plurality of ornaments 102. Ornaments 102 may be one or more of the ornaments described with respect to ornaments 20 and 22 above. Though shown as a circular plate in FIGS. 13 and 14, frame 104 may be any type of a planar or non-planar frame, circular or non-circular frame, for example, having the properties described above for frame 11. In one aspect of the invention, frame 104 may comprise a frame similar to frame 11 shown in FIG. 11; frame panels 14 shown in FIGS. 1 through 6, 7A, and 7B; frame 41 shown in FIG. 8; frame 51 shown in FIG. 9; frame 61 shown in FIG. 10; frame 81 shown in FIG. 11; or frame 91 shown in FIG. 12; among other types of shapes of frames that may be used to mount ornaments. Frame 104 may include apertures or holes 107 that may be used for mounting arrangement 100 to other structures, for example, to a light fixture.

Figure 15:
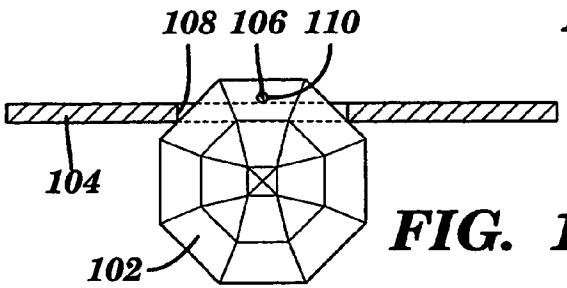
FIG. 15 is a cross-sectional view of the aspect of the invention shown in FIGS. 14 and 15 as viewed along lines 15-15 in FIG. 13.

According to one aspect of the invention, frame 104 includes a plurality of apertures or perforations 108 into which a plurality of ornaments 102 may be positioned. Though apertures 108 shown in FIGS. 13 and 14 are diamond-shaped, in one aspect of the invention, apertures 108 may take any shaped adapted to receive an ornament 102, for example, any conventional shape, including polygonal, circular, and oval, among other shapes. According to one aspect, at least one dimension of aperture 108 may be smaller in dimension than at least one dimension of ornaments 102 whereby ornaments 102 bear against at least one edge of aperture 108 when ornament 102 is positioned into aperture 108. The relationship of the size of ornament 102 and the size of aperture 108 is more clearly illustrated in FIG. 15. FIG. 15 is a cross-sectional view of arrangement 100 shown in FIGS. 13 and 14 as viewed along lines 15-15 in FIG. 13. Though in one aspect of the invention, the apertures 108 may be smaller than ornaments 102, in another aspect of the invention, the apertures 108 may be larger than ornaments 102. For example, when the apertures 108 are larger than the ornaments 102, the ornaments may be retained by one or more wires 106 substantially alone, for instance, when the top of fixture 100 is directed downward (that is, when the arrangement shown in FIG. 15 is inverted.)

Figure 28:
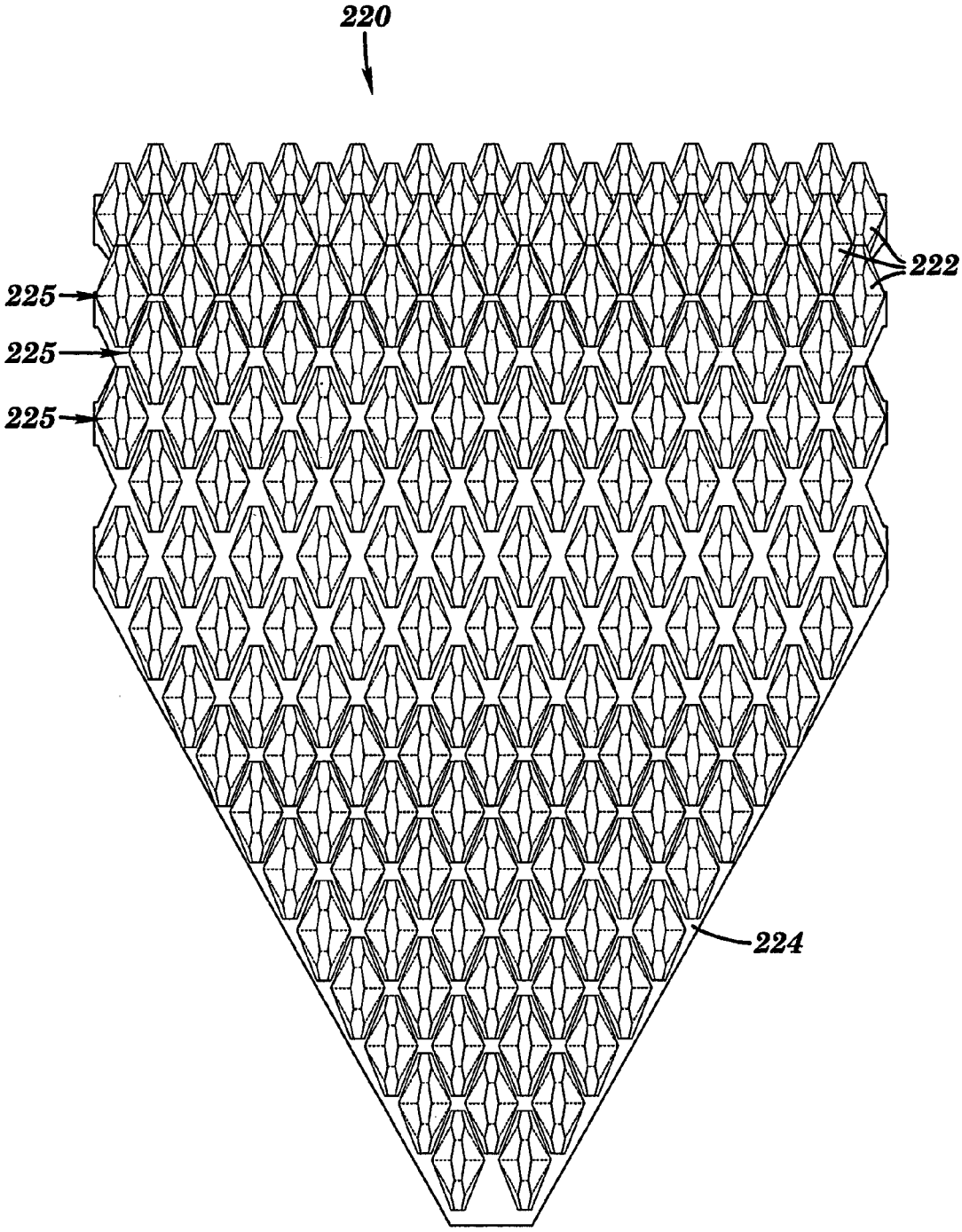
FIGS. 28, 29, and 30 are a front elevation view, a side elevation view, and a rear elevation view, respectively, of another aspect of the invention.
Figure 29:
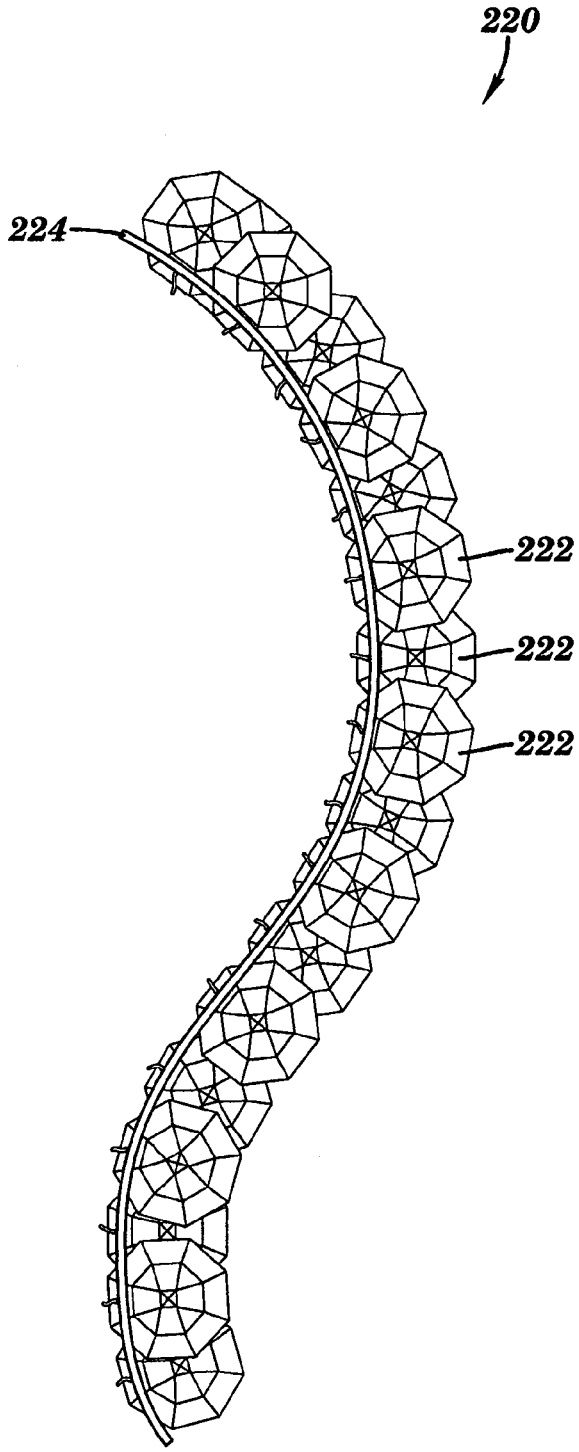
Figure 30:
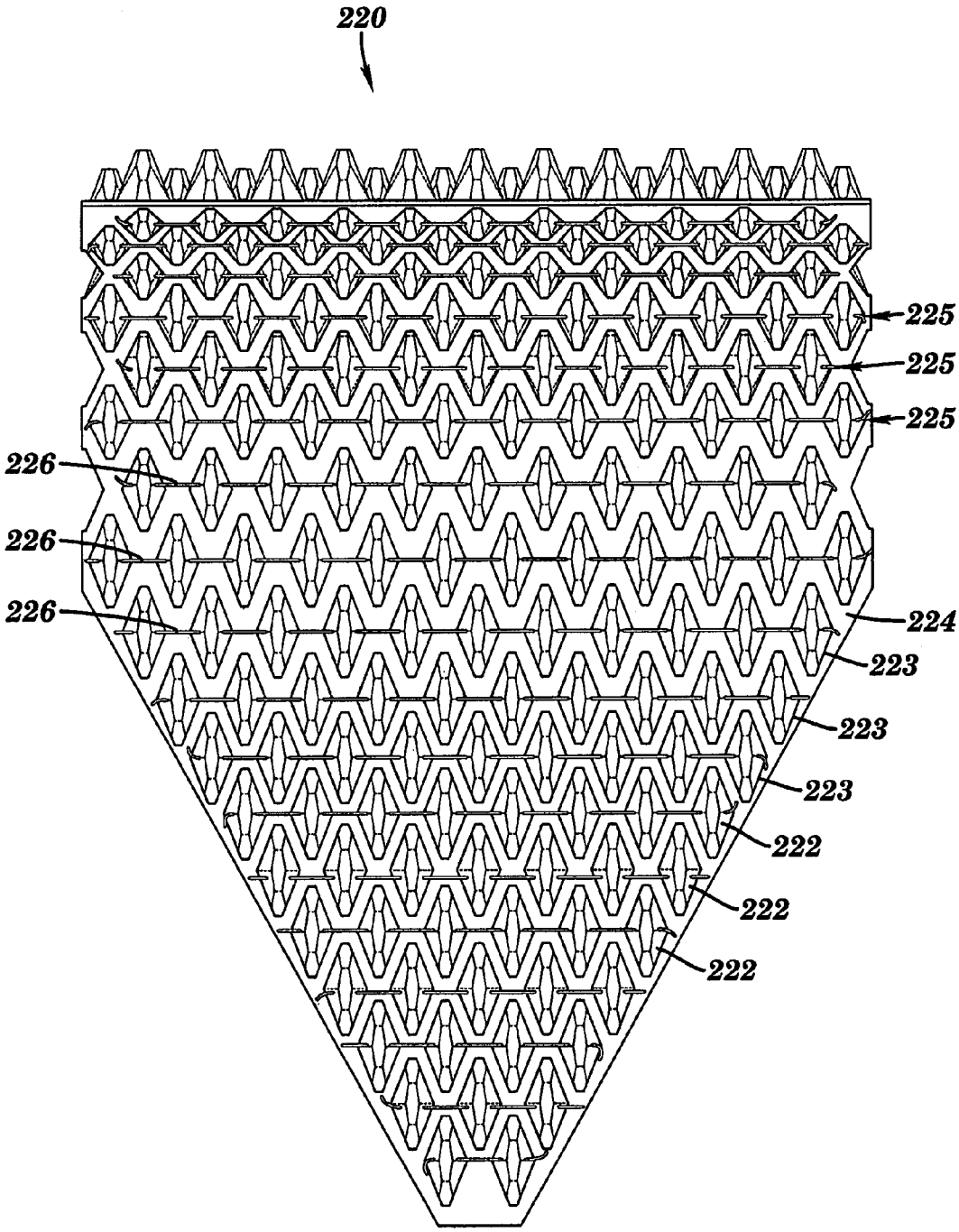

As shown in FIG. 15, according to one aspect of the invention, ornaments 102 include at least one perforation or through hole 110 through which wire 106 may be inserted to retain ornaments 102 onto frame 104. According to one aspect of the invention, ornament 102 may include at least two through holes 110 and wire 106 may be threaded through the at least two though holes 106. Wire 106 may be metallic, for example, made from made of iron, steel, stainless steel, aluminum, titanium, nickel, copper, silver, or gold, among other metals. In one aspect of the invention, wire 106 is non-metallic, such as plastic, for example, wire 106 may be made from polyethylene (PE), polypropylene (PP), polyester (PE), polytetraflouroethylene (PTFE), acrylonitrile butadiene styrene (ABS), among other plastics. In one aspect of the invention, wire 106 may be made from any material that is formable, for example, formable to conform to being threaded through a plurality of perforations 110 in ornaments 102. Though wire 106 is illustrated as a circular wire, wire 106 may have a variety of cross-sectional shapes, for example, wire 106 may have a cross-sectional shape that is circular, ellipsoidal, triangular, rectangular, square, or any other polygonal shape. According to one aspect of the invention, wire 106 may be made from coated or uncoated wire. In one aspect, wire 106 may be made from about 0.010 inch wire to about 0.125 inch wire, for example, wire having a diameter from about 0.020 inches to about 0.030 inches. In one aspect of the invention, wire 106 may be made from nickel-chrome wire having a diameter of about 0.026 inches. In one aspect of the invention, for example, as shown in FIG. 30, wire 106 may have some structural rigidity, that is, wire 106 may be sufficiently rigid whereby by wire 106 may be capable of withstanding at least some axial load, that is, "column load," and undergo little or no lateral deflection. This feature can be especially useful when threading wire 106 through a series of ornaments in a row, for example, as shown in FIGS. 28 through 30. In one aspect of the invention, wire 106 may comprise a rod or elongated pin that can be used to penetrate or "skewer" a plurality of ornaments. In one aspect of the invention, rod 106 may be fabricated by conventional means, for example, by drawing, by stamping, or by laser, water-jet, or EDM cutting from plate, among other methods.

According to one aspect of the invention, wire 106 may be integrally mounted to frame 104, for example, brazed, welded, or attached to frame 104 by means of mechanical fasteners. According to another aspect of the invention, wire 106 may not be integrally mounted to frame 104, but may be retained or captured to frame 104 by means of mechanical interference between wire 106, frame 104, and ornament 102. For example, in one aspect of the invention, ornaments 102 may be retained or captured on frame 104 by means of wire 106. Specifically, in one aspect, where ornament 102 is larger in dimension than aperture 108, when ornament 102 is positioned in aperture 108 (for example, as shown in FIG. 15) and wire 106 is inserted through perforation 110, contact between wire 106 and frame 104 may prevent ornament 102 from being removed from aperture 108, thus capturing ornament 102.

In one aspect of the invention, wire 106 may be manipulated to enhance the capture of ornament 102 onto frame 104. In one aspect, wire 106 may comprise a first end and a second end that may be attached or bound to each other, for example, by means of simple twisting or by means of fusing (for example, welding) or mechanical fastening to provide bound ends 109. In one aspect, the bound or twisted ends 109 of wire 106 may be attached to frame 104, for example, by means of welding or mechanical fastening. In another aspect of the invention, the ends of wire 106 may be deformed to minimize or prevent the disengagement of wire 106 from one or more perforations 110 in ornaments 102, for example, by crimping wire 106 or bending the end of wire 106 about an ornament 102 or about frame 104. In another aspect of the invention, the free ends of wire 106 may be bound to frame 104 by conventional means, for example, by welding or mechanical fasteners.

According to one aspect of the invention, individual wires 106 may associated with at least some of the apertures 108, for example, individual lengths of wires may be mounted to frame 104 whereby the individual wire projects over aperture 108, for example, in a fashion similar to the way post or pin 18 projects into aperture 16 as shown in FIGS. 1 through 6. In one aspect of the invention, the individual length of wire 106 may be fused to frame 104, for example, by brazing or welding, or attached by means of an adhesive. According to one aspect of the invention, ornaments 102 may be mounted to individual wires 106 in a fashion similar to that shown in FIGS. 3 through 5, for example, by deflecting the individual wires 106 from a first position, substantially coplanar with frame 104, to a second position, at an angle to frame 104, for example, at an angle $\alpha$ shown in FIG. 4. The ornament 102 may be mounted to the individual wire 106 and then the wire 106 deflected back to the first position, for example, as shown in FIG. 5 for post or pin 18. According to one aspect of the invention, by mounting an ornament 102 in this fashion to wire 106 the ornament 102 may be retained in the aperture 108 by means of the wire 106 and at least one of the internal surfaces of the apertures 108.

As discussed above, aspects of the invention illustrated in FIGS. 13 through 15 may be applied to any one of the frames disclosed in FIGS. 1 through 12. For example, with respect to FIGS. 1 through 8, one or more pins or posts 18 may be removed from the frames shown and the ornaments shown may be mounted to their respective frames by means of a wire, such as wire 106 shown in FIGS. 13-15. Similarly, with respect to the arrangements shown in FIGS. 9 through 12, one or more of pins 58 in FIG. 9, pins 68 in FIG. 10, pins 84 in FIG. 11, or pins 68 in FIG. 12 may be removed and their retaining function provided by one or more wires 106 of FIGS. 13 through 15. In one aspect, pins 18, 58, 68, or 84 may be replaced by an individual wire mounted to the respective frame, for example, by welding; or one or more of pins 18, 58, 68, or 84 may be replaced by one or more wires 106 engaging two or more ornaments as discussed with respect to FIGS. 13 through 15. For example, FIG. 16 illustrates one aspect of the invention in which a wire is used to retain ornaments by to a frame similar to frame 61 shown in FIG. 10.

As will be apparent to those skilled in the art, according to aspects of the invention, the wire mounting arrangement shown in FIGS. 13-15 provides the desired control over the positioning and orientation of ornaments 102 in a manner similar to the control provided by posts or pins 18 of FIGS. 1 through 6. According to aspects of the invention, by providing an aperture 108 in plate 104 that is designed to supplement the shape of ornament 102, the interaction of the wire 106 (or pin 18) with ornament 102 and with the internal surface of aperture 108 positions and orients ornament 102 in a predetermined position and orientation, that is, with little or no influence of the force of gravity. In one aspect, aperture 108 is designed to be precisely supplemented by ornament 102 whereby ornament 102 interacts, bears against, or contacts the internal surface of aperture 108 whereby ornament 102 can be positioned and oriented as desired.

Figure 16:
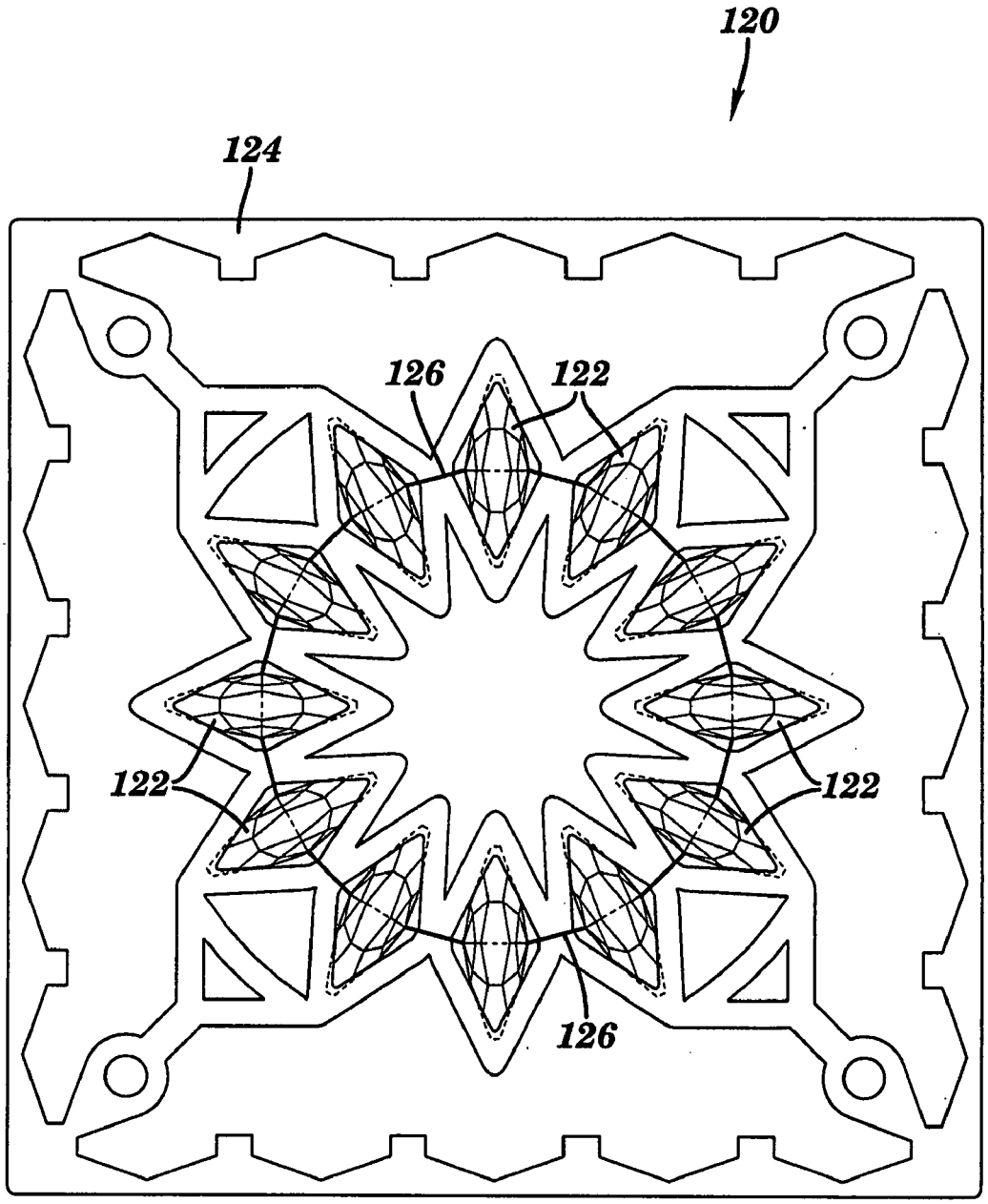
FIG. 16 is a rear plan view of another aspect of the present invention.

FIG. 16 is a rear plan view of another arrangement or fixture 120 according to another aspect of the present invention. For example, FIG. 16 displays a view of fixture 120 that typically would not be visible to the viewer of fixture 120. Arrangement 120 includes a plurality of ornaments 122 mounted in a frame 124 by means of one or more wires 126. Frame 124 is similar to frame 61 of FIG. 10, but pins 68 of frame 61 and their function have been replaced by wire 126. Wire 126 may typically have all the attributes and means of mounting as wire 106 described in FIGS. 13 though 15. Ornaments 122 may have all the attributes of ornaments 20, 22 described above and frame 124 may have all the attributes or frame 11 described above.

Figure 17:
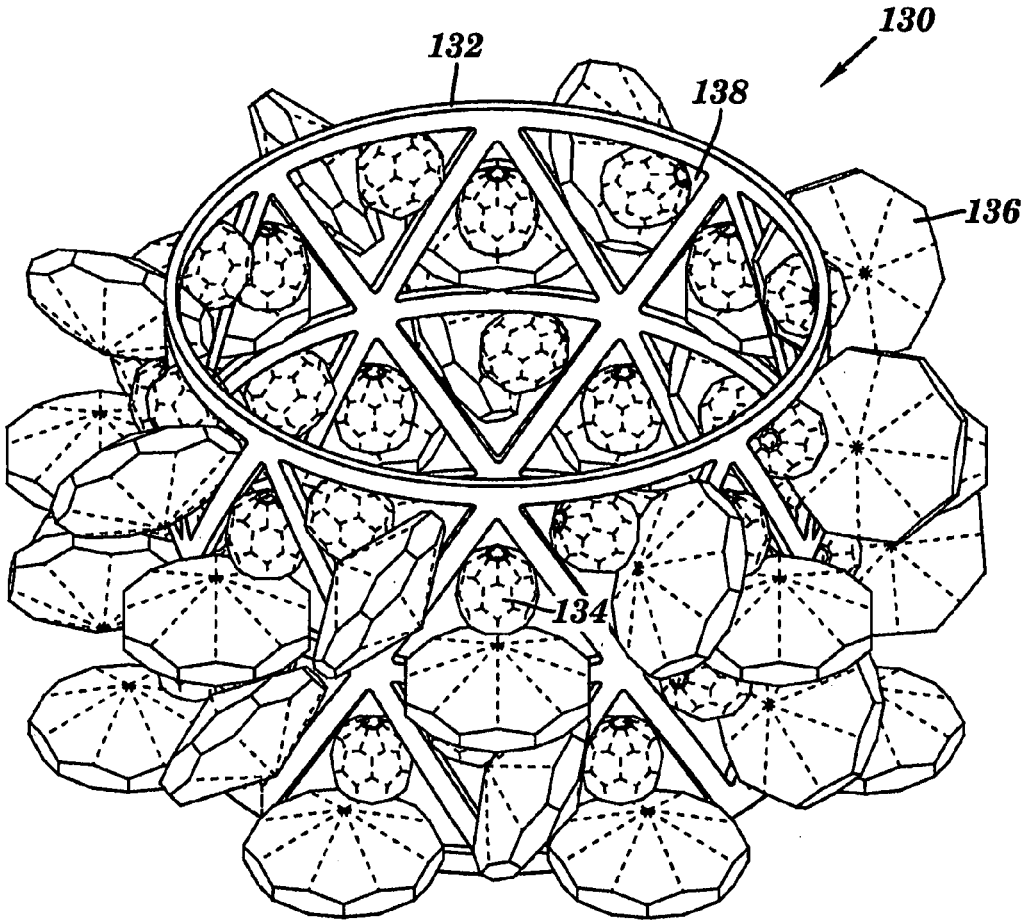
FIG. 17 is a perspective view of a further aspect of the invention, similar to the aspect shown in FIG. 8.
Figure 18:
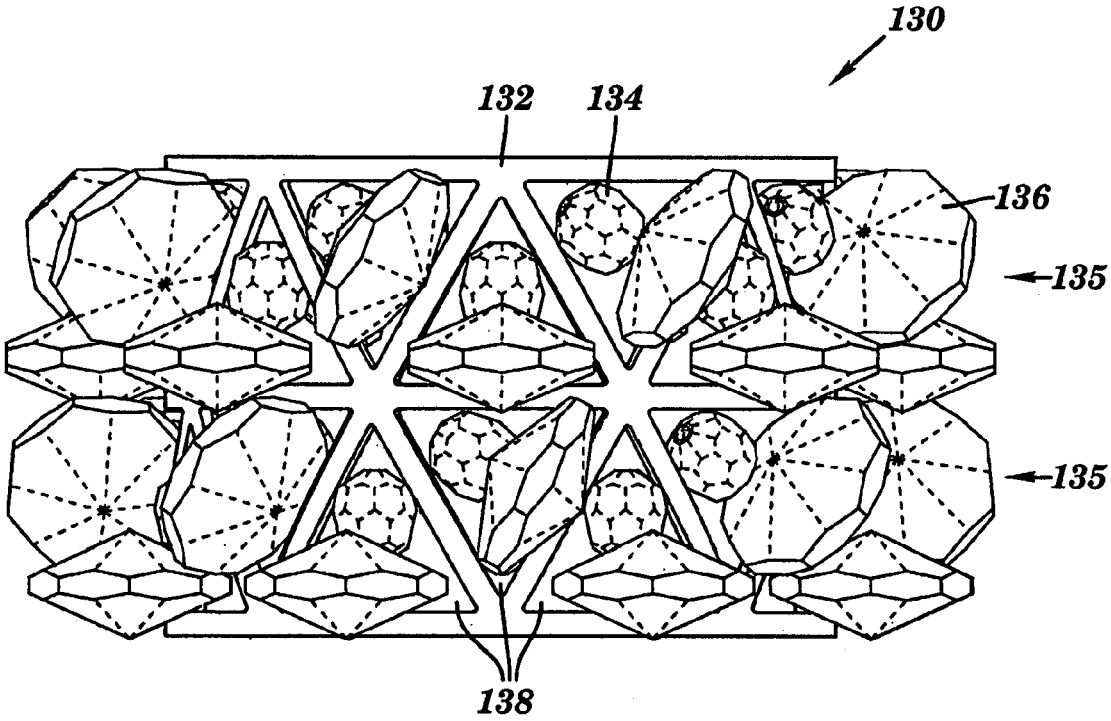
FIG. 18 is a front elevation view of the aspect of the invention shown in FIG. 17.
Figure 19:
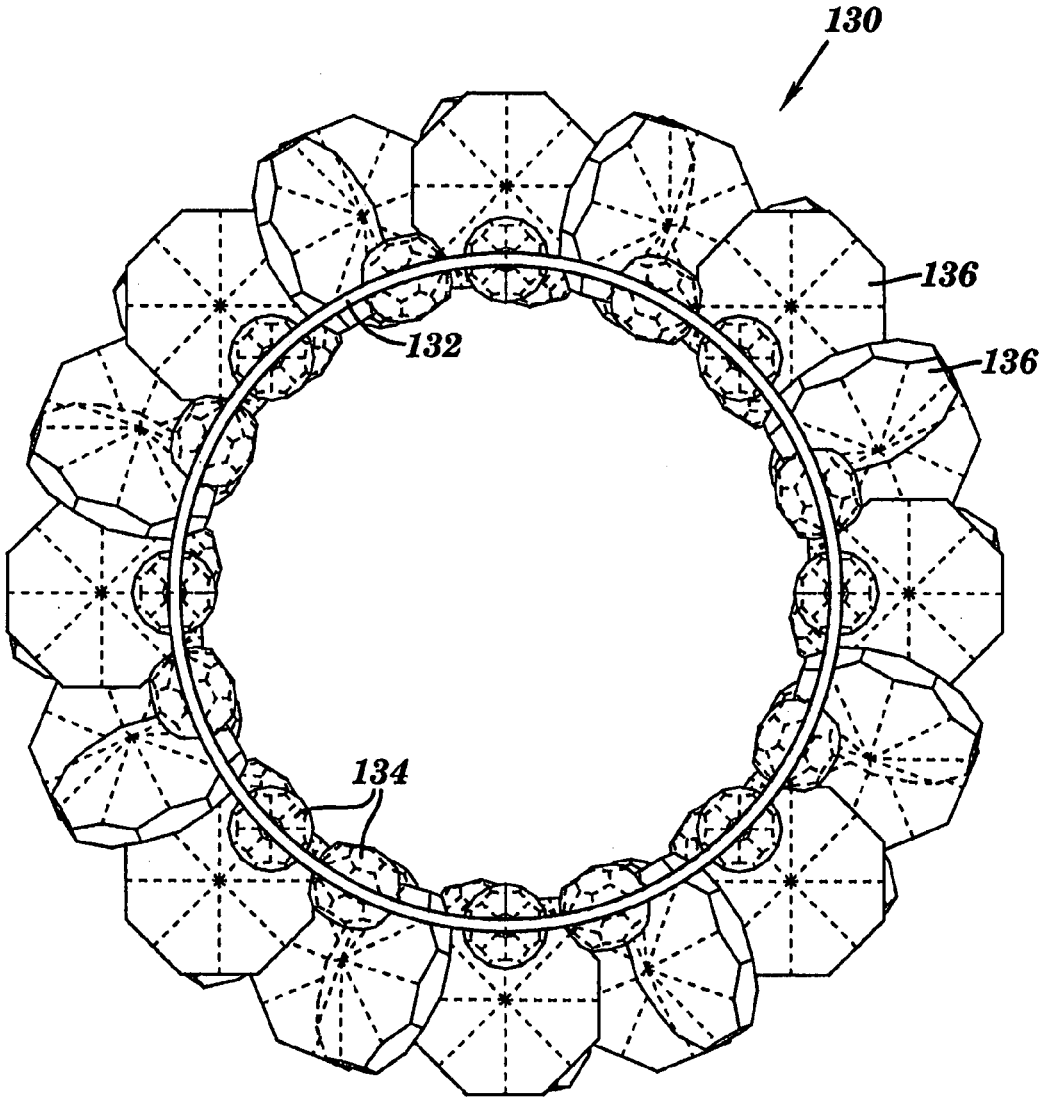
FIG. 19 is a top plan view of the aspect of the invention shown in FIG. 17.

FIG. 17 is a perspective view of a further ornamental fixture 130 according to an aspect of the invention. The ornamental fixture 130 shown in FIG. 17 is similar to the ornamental fixture 40 shown in FIG. 8. FIG. 18 is a front elevation view of the aspect of the invention shown in FIG. 17 and FIG. 19 is a top plan view of the aspect of the invention shown in FIG. 17.

As shown in FIG. 17, fixture 130 includes a multi-apertured cylindrical frame 132 having a plurality of ornaments 134 and 136, for example, a plurality of ornaments 134 and/or a plurality of ornaments 136 mounted in apertures 138. As shown most clearly in FIG. 18, fixture 130 includes two rows 135 of ornaments in a horizontal configuration. As will be shown in FIGS. 20 and 21, in one aspect, one or more rows 135 may be provided. According to one aspect of the invention, rows 135 may also be oriented vertically or at an oblique angle, for example, at about 45 degrees from an edge of frame 132. It will be understood that any aspects of this invention shown herein may comprise rows, for example, rows similar to roes 135, that may be oriented horizontally, vertically, obliquely, or a combination thereof.

Though frame 132 is illustrated as circular cylindrical, frame 132 may also be triangular cylindrical, rectangular cylindrical, cubical, hexagonal cylindrical, octagonal cylindrical, spherical, and pyramidal, among other shapes. Similarly, though in FIG. 17 ornaments 134 are shown as multifaceted spheres and ornaments 136 are shown as multifaceted octagons, according to aspects of the invention, ornaments 134 and 136 may be any one or more of the ornaments described above with respect to ornaments 20 and 22 shown, for example, in FIG. 2. Also, frame 132 may have one or more of the attributes, for example, made from one or more of the materials, described above with respect to frame 11 shown in FIG. 1. As shown in FIG. 17, the apertures 138 in frame 132 may typically be triangular in shape and have at least one post or pin (not shown) on to which ornaments 134 and 136 may be mounted, as is typical of aspects of the invention. As described above with respect to other embodiments, apertures 138 in frame 132 may take other shapes, for example, the shapes of the apertures shown in FIGS. 9, 10, and 12, among others.

According to one aspect of the invention, ornaments 134 and 136 may be mounted in or to frame 132, as described above, according to aspects of the present invention. For instance, at least one ornament 134 and/or 136, or three or more ornaments, may be mounted to a pin or post on frame 132 in a fashion similar or essentially identical to that shown and described with respect to FIGS. 1 through 6. For example, one or more ornaments may be mounted to frame 130 by deflecting the post or pin mounted to frame 132 from a first position to a second position, mounting the one or more ornaments, and then deflecting the post with one or more ornaments back to the first position. As is typical of the present invention, when the post with one or more ornaments is deflected back to the first position, the one or more ornaments are retained by the pin and at least one side of an aperture 138 in frame 132.

In another aspect of the invention, at least one ornament 134, 136 may be mounted to frame 136 of fixture 130 by means of one or more wires (not shown), in a fashion similar to that shown and described with respect to FIGS. 13 through 16.

Figure 20:
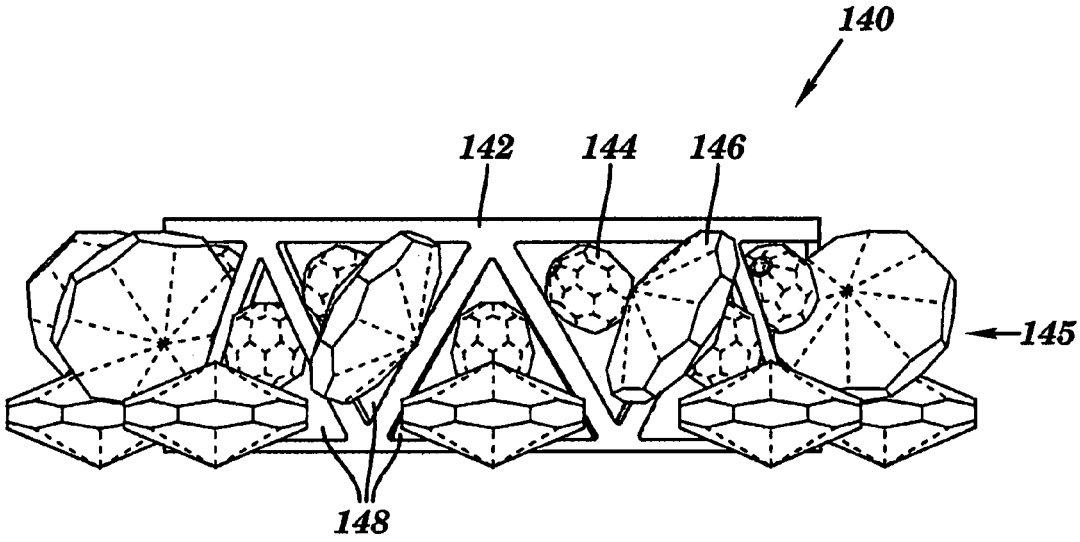
FIG. 20 is a front elevation view of another aspect of the invention.

FIG. 20 is a front elevation view of a further ornamental fixture 140 according to an aspect of the invention. As shown in FIG. 20, fixture 140 includes a multi-apertured cylindrical frame 142 having a plurality of ornaments 144 and 146, similar to ornaments 134 and 136 shown in and described with respect to FIGS. 17 through 19, mounted in apertures 148. The ornamental fixture 140 shown in FIG. 20 is similar to the ornamental fixture 130 shown in FIGS. 17 through 20, but having a single row of 145. According to aspects of the invention, ornaments 144 and 146 may be mounted to frame 142 by means of pins or posts (not shown), or by means of one or more wires (not shown), as discussed above.

Figure 21:
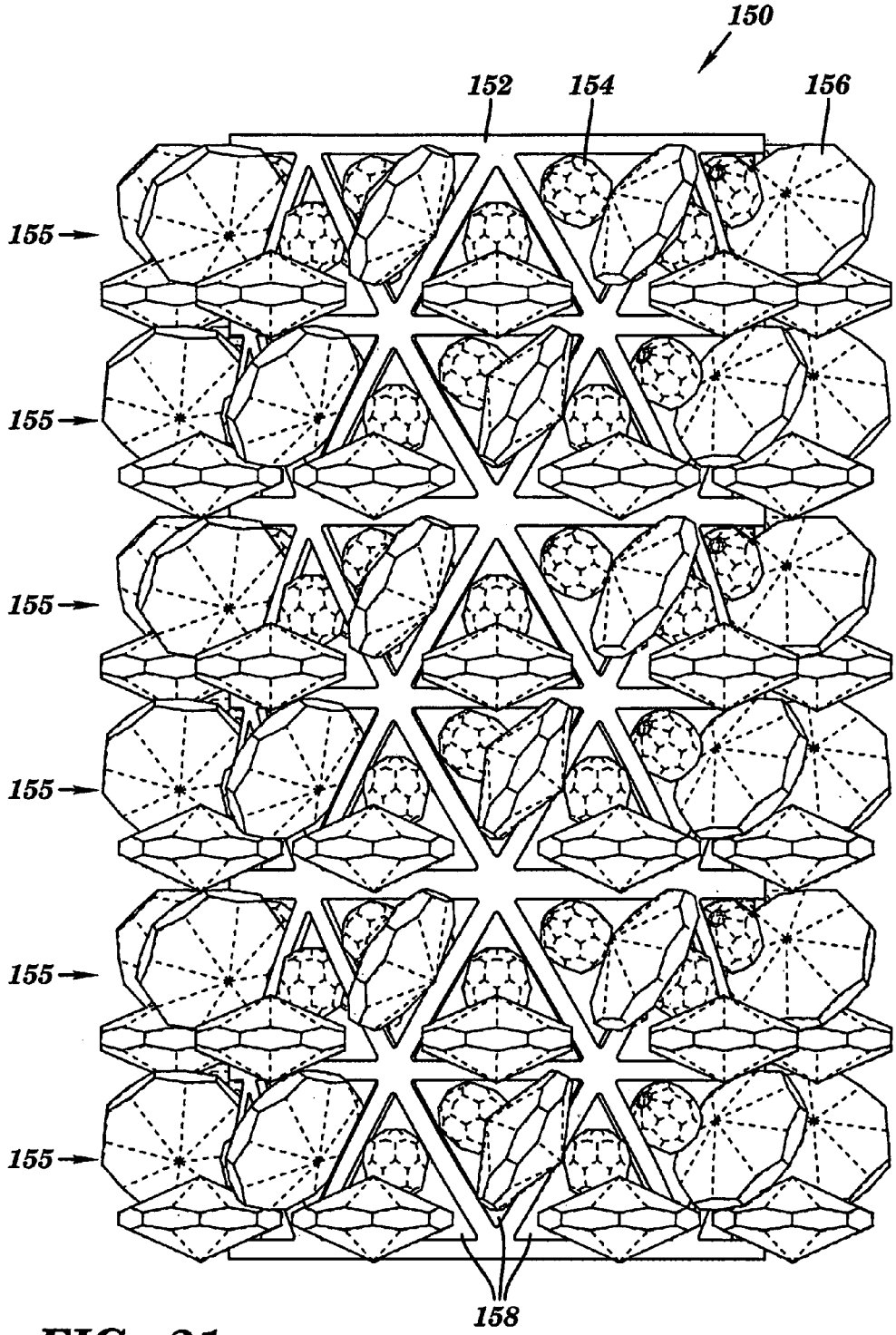
FIG. 21 is a front elevation view of another aspect of the invention.

FIG. 21 is a front elevation view of a further ornamental fixture 150 according to an aspect of the invention. As shown in FIG. 21, fixture 150 includes a multi-apertured cylindrical frame 152 having a plurality of ornaments 154 and 156, similar to ornaments 134 and 136 shown in and described with respect to FIGS. 17 through 19, mounted in apertures 158. The ornamental fixture 150 shown in FIG. 20 is similar to the ornamental fixtures 130 shown in FIGS. 17 through 19 and fixture 140 shown in FIG. 20 but having multiple rows of ornaments 155, for example, 6 rows, though more or less rows 155 may be provided. According to one aspect of the invention, rows 155 may also be directed vertically or at an oblique angle, for example, at about 45 degrees from the edge of frame 152. According to aspects of the invention, ornaments 154 and 156 may be mounted to frame 152 by means of pins or posts (not shown), or by means of one or more wires (not shown), as discussed above.

Figure 22:
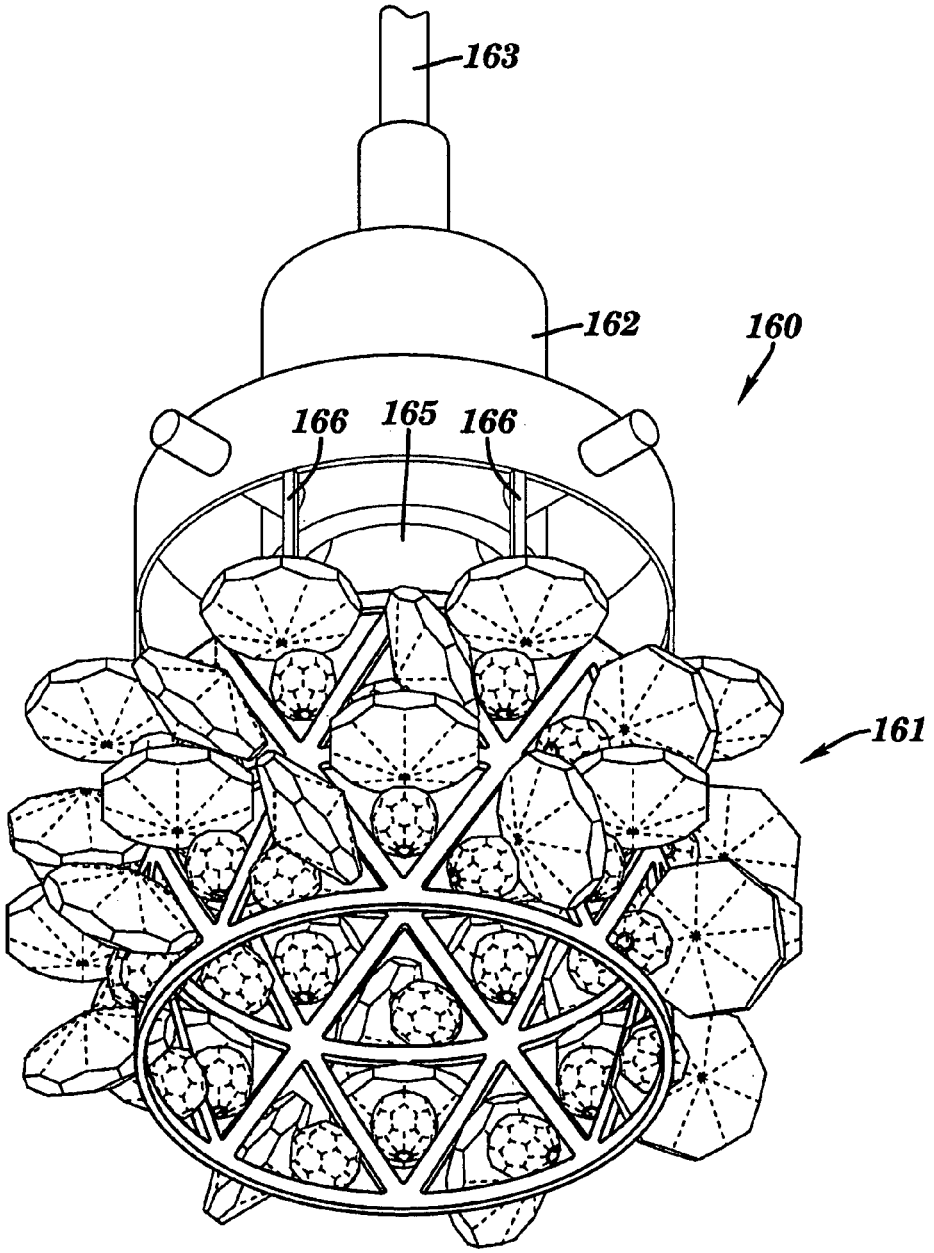
FIGS. 22 through 27 are perspective views of further aspects of the invention.

FIGS. 22 through 26 are perspective views of further aspects of the invention. FIG. 22 is a perspective view of a light fixture 160 having an ornament fixture 161. According to aspects of the present invention, ornament fixture 161 may be similar to the arrangements and fixtures shown in FIGS. 1 through 21. For example, as shown in FIG. 22, in one aspect, ornament fixture 161 may be similar to the fixtures shown in FIGS. 17 through 21. As shown in FIG. 22, light fixture 160 includes a lamp holder 162 supported by a power/support cord 163. Lamp holder 162 is adapted to hold a light bulb, or similar light source, 165 and is adapted to support ornament fixture 161. In one aspect of the invention, ornament fixture 161 may be mounted to lamp holder 162 by a plurality of support posts 166. Support posts 166 may be integral with lamp holder 162, for example, cast or forged as a single part or welded, or support posts 166 may be mounted to lamp holder 162 by mechanical fasteners. Similarly, the ornament fixture 161 may be integral with support posts 166, for example, the frame of ornament fixture 161 may cast or forged as a single part or welded to support posts 166, or ornament fixture 161 may be mounted to support posts 166 by mechanical fasteners. In one aspect of the invention, the ornaments in ornament fixture 161 may comprise one or more colors, for example, one ornament type may be green and another ornament type may be pink. It will be apparent to those of skill in the art that the size, for example, length or diameter, of light fixture 160, or specifically, ornament fixture 161, may vary as dictated by location, design, and use.

Figure 23:
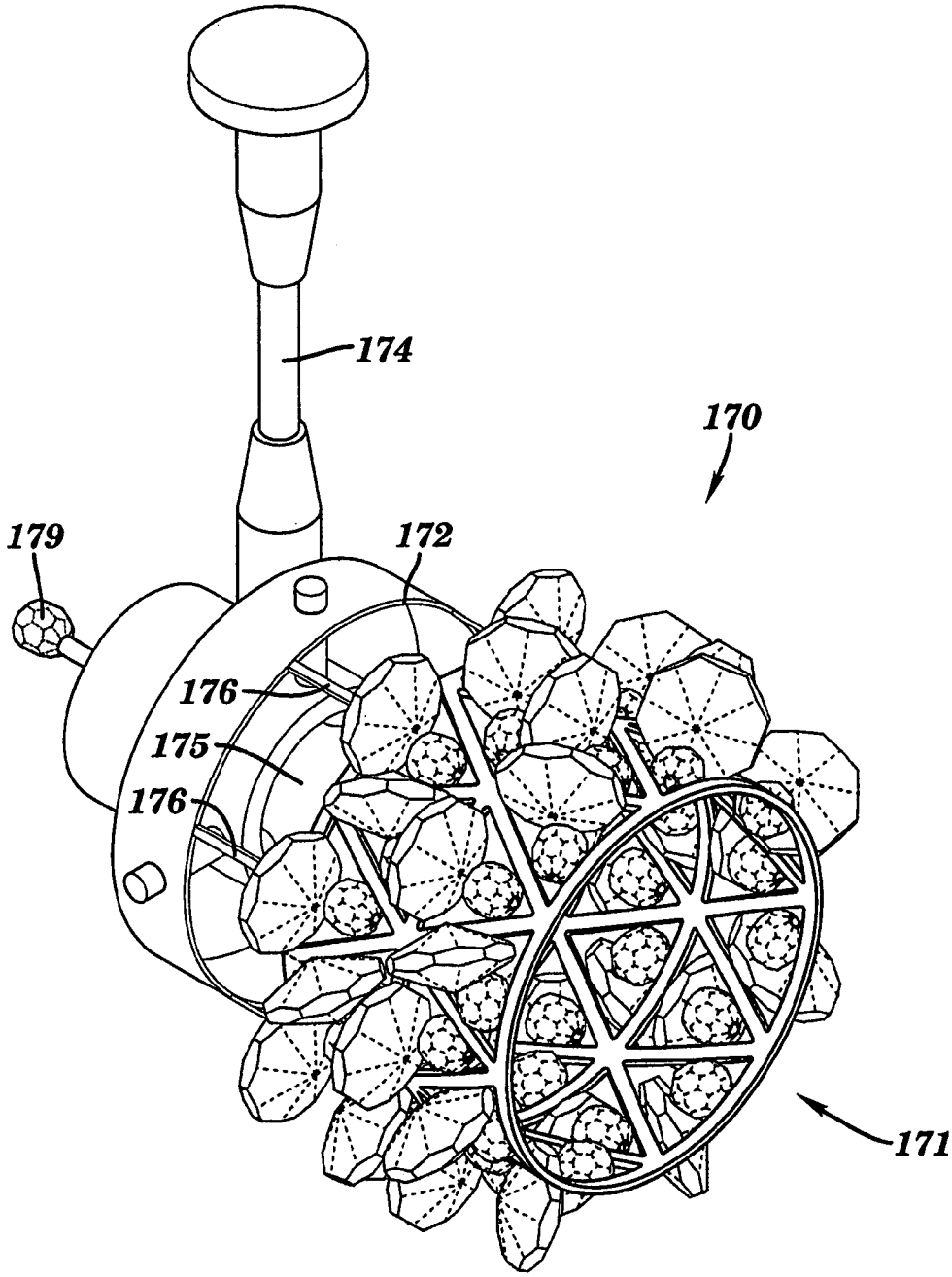

FIG. 23 is a perspective view of another light fixture 170 having an ornament fixture 171 according to another aspect of the invention. Ornament fixture 171 may be similar to the arrangements and fixtures shown in FIGS. 1 through 21. For example, as shown in FIG. 23, in one aspect, ornament fixture 171 may be similar to the fixtures shown in FIGS. 17 through 21. As shown in FIG. 23, light fixture 170 includes a lamp holder 172 supported by a power/support post 174 mounted to surface 173. In one aspect of the invention, light fixture 170 may be used for "track lighting," that is, post 174 may be adapted to be adjustably mounted to a horizontal track (not shown) mounted above light fixture 170. As shown in FIG. 23, lamp holder 172 may be adjustably mounted to support post 174, whereby the direction of orientation of lamp holder 172 may be varied, for example, the lamp holder 172 may be mounted to support 174 by means of a ball-and-socket or similar connection. In one aspect of the invention light fixture 170 comprises a directional or aimable light fixture, for example, an aimable spotlight. According to one aspect, the direction toward which the light of light fixture 170 may be directed can be varied, for example, light fixture 170 may be swiveled, for example, by means of a ball-and-socket connection with post 174, to direct a beam of light in any desired location, for example, toward the ceiling, the floor, a wall, a nearby structure, or piece of art work, among other items.

Lamp holder 172 is adapted to hold a light bulb, or similar light source, 175 and may be adapted to support ornament fixture 171. In a fashion similar to light fixture 160 shown in FIG. 22, in one aspect of the invention, ornament fixture 171 may be mounted to lamp holder 172 by a plurality of support posts 176. Support posts 176 may be integral with lamp holder 172, for example, cast or forged as a single part or welded, or support posts 176 may be mounted to lamp holder 172 by mechanical fasteners. Similarly, the ornament fixture 171 may be integral with support posts 176, for example, the frame of ornament fixture 171 may be cast or forged as a single part or welded to support posts 176, or ornament fixture 171 may be mounted to support posts 176 by mechanical fasteners. Light fixture 170 may also include one or more ornamental embellishments, such as multifaceted sphere 179 mounted to lamp holder 172. In one aspect of the invention, the ornaments in ornament fixture 171 may comprise one or more colors. It will be apparent to those of skill in the art that the size, for example, length or diameter, of light fixture 170, or specifically, ornament fixture 171, may vary as dictated by location, design, and use.

Light fixture 170 shown in FIG. 23 exemplifies one of the advantages of aspects of the present invention compare to the prior art. As discussed above, light fixture 170 may be aimable to any desired location within a room. However, unlike prior art ornament mounting arrangements, the change in the direction of light fixture 170 has little or no impact upon the relative position or orientation of the ornaments mounted in fixture 171. Unlike prior art mountings where ornaments my hang from hooks, chains, or other devices in which the position or orientation of the ornaments can be dramatically affected by gravity, aspects of the present invention, such as light fixture 170, impose little or no impact upon the position or orientation of the ornaments when the direction of the light fixture is varied. Due to the dramatic variation in ornament position or orientation that can result from a change in fixture orientation, directional or aimable light fixtures, such as spotlights, are typically avoided. Aspects of the present invention provide new design opportunities for directional lighting.

Figure 24:
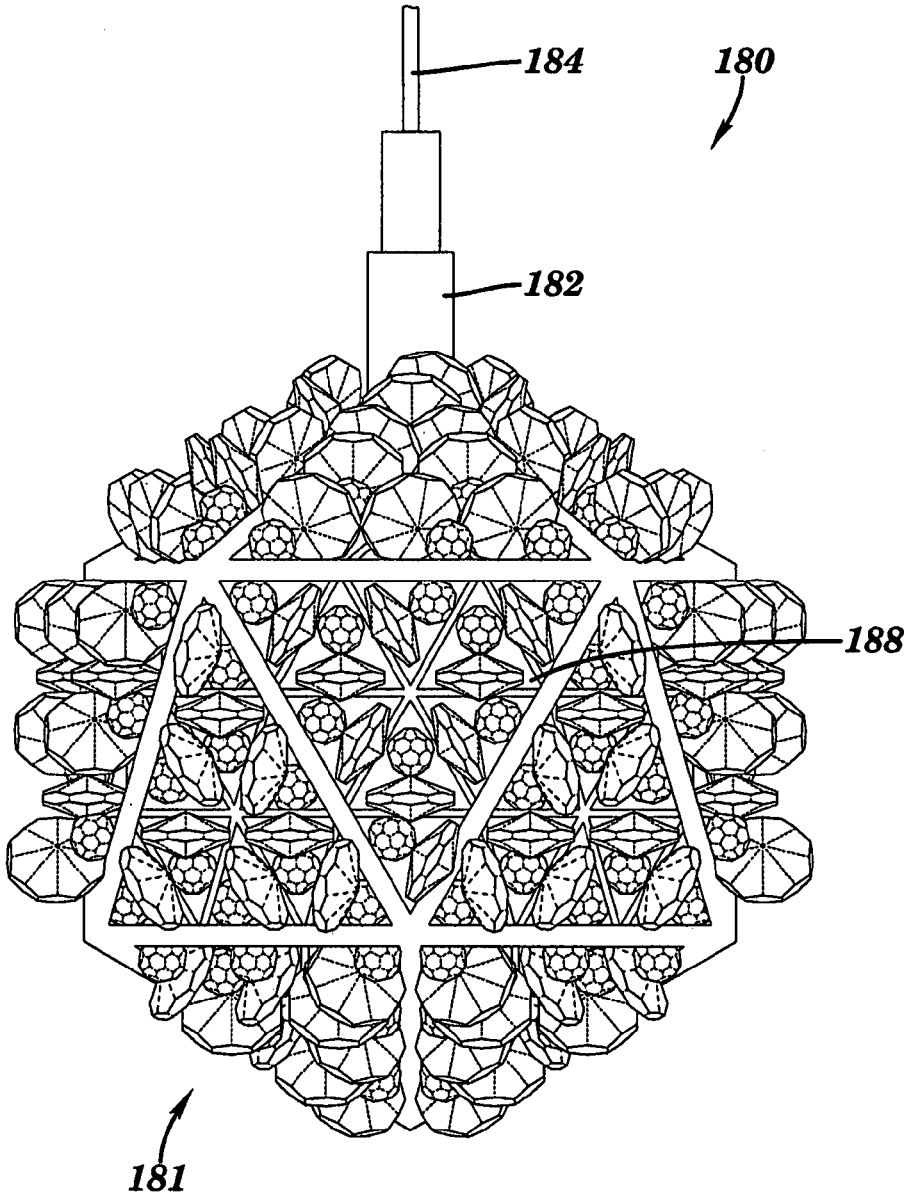

FIG. 24 is a perspective view of another light fixture 180 having an ornament fixture 181 according to another aspect of the invention. Ornament fixture 181 may be similar to the arrangements and fixtures shown in FIGS. 1 through 21. For example, as shown in FIG. 24, in one aspect, ornament fixture 171 may be similar to the fixtures shown in FIGS. 1 through 6, 7A, and 7B. For example, as shown in FIG. 24, ornament fixture 181 may comprise a plurality of ornamented panels 188, for example, ornamented frame panels similar to frame panels 14 shown in FIGS. 1 and 2. As shown in FIGS. 7A and 7B, ornamented panels may be formed into pyramidal structures. As shown in FIG. 24, according to one aspect of the invention, ornamented frame panels 188 may also be formed into, among other shapes, faceted spheres. In the aspect shown in FIG. 24, triangular frame panels 188 similar to panels 14 in FIGS. 1 and 2 may be fashioned into a 22 triangular panels to provide a faceted sphere. In the aspect shown in FIG. 24 the 20 triangular panels are supplemented with a pyramidal structure at the top and bottom where the top pyramidal structure is truncated to permit access to the inside of the structure. It will be apparent to those of skill in the art that more or fewer panels may be used to vary the size, for example, diameter, and shape of light fixture 180, or specifically, ornament fixture 181, as dictated by location, design, and use.

As shown in FIG. 24, light fixture 180 includes a lamp holder 182 mounted within fixture 181 that is supported by a power/support cord 184. In one aspect of the invention, light fixture 180 may be used for "track lighting," that is, cord 184 may be adapted to be adjustably mounted to a horizontal track (not shown) mounted above light fixture 180. Lamp holder 182 is adapted to hold a light bulb, or similar light source (not shown) within fixture 181 and lamp holder 182 may be adapted to support ornament fixture 181. In a fashion similar to light fixture 160 shown in FIG. 22, in one aspect of the invention, ornament fixture 181 may be mounted to lamp holder 182 by a plurality of support braces (not shown). The support braces may be integral with lamp holder 182, for example, cast or forged as a single part or welded, or support braces may be mounted to lamp holder 182 by mechanical fasteners. Similarly, the ornament fixture 181 may be integral with the support braces, for example, the frame of ornament fixture 181 may be cast or forged as a single part or welded to the support braces, or ornament fixture 181 may be mounted to the support braces by mechanical fasteners. In one aspect of the invention, the ornaments in ornament fixture 181 may comprise one or more colors, for example, one ornament type in fixture 181 may be green and another ornament type may be pink.

Figure 25:
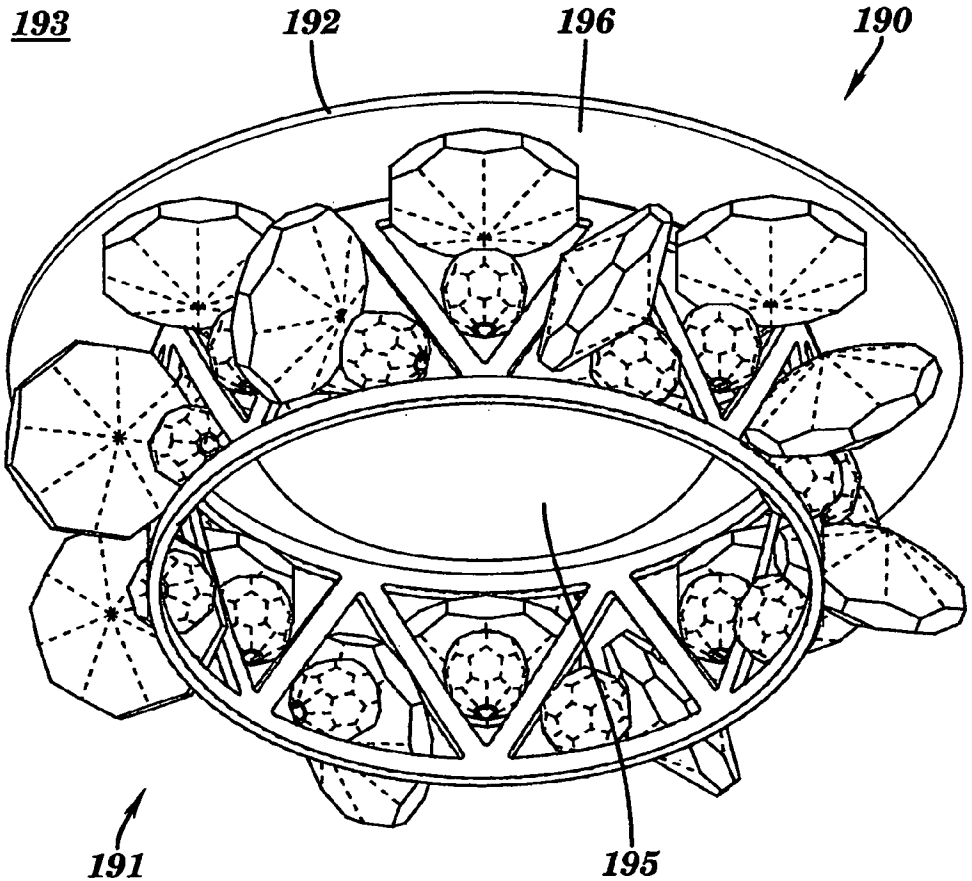

FIG. 25 is a perspective view of another light fixture 190 having an ornament fixture 191 according to another aspect of the invention. Again, ornament fixture 191 may be similar to the ornament arrangements and fixtures shown in FIGS. 1 through 21. For example, as shown in FIG. 25, in one aspect, ornament fixture 191 may be similar to the fixtures shown in FIGS. 8 and 17 through 21. For example, as shown in FIG. 25, ornament fixture 191 may comprise the fixture 140 shown in FIG. 20.

As shown in FIG. 25, light fixture 190 includes a lamp holder 192 mounted above ornamental fixture 191. Lamp holder 192 may be mounted within surface a 193, that is, light fixture 190 may comprise a "recessed" light fixture. In one aspect of the invention, light fixture 190 comprises a recessed light fixture powered by an electrical cord (not shown) located behind surface 193. Lamp holder 192 is adapted to hold a light bulb, or similar light source, 195. Light holder 192 may include an escutcheon 196. In one aspect of the invention, ornament fixture 191 may be mounted to lamp holder 192, for example, to escutcheon 196 by conventional means. For example, fixture 191 may be cast or forged as a single part with light holder 192, fixture 191 may be welded to light holder 192, or fixture 191 may be mounted to lamp holder 192 by mechanical fasteners. In one aspect of the invention, the ornaments in ornament fixture 191 may comprise one or more colors.

Figure 26:
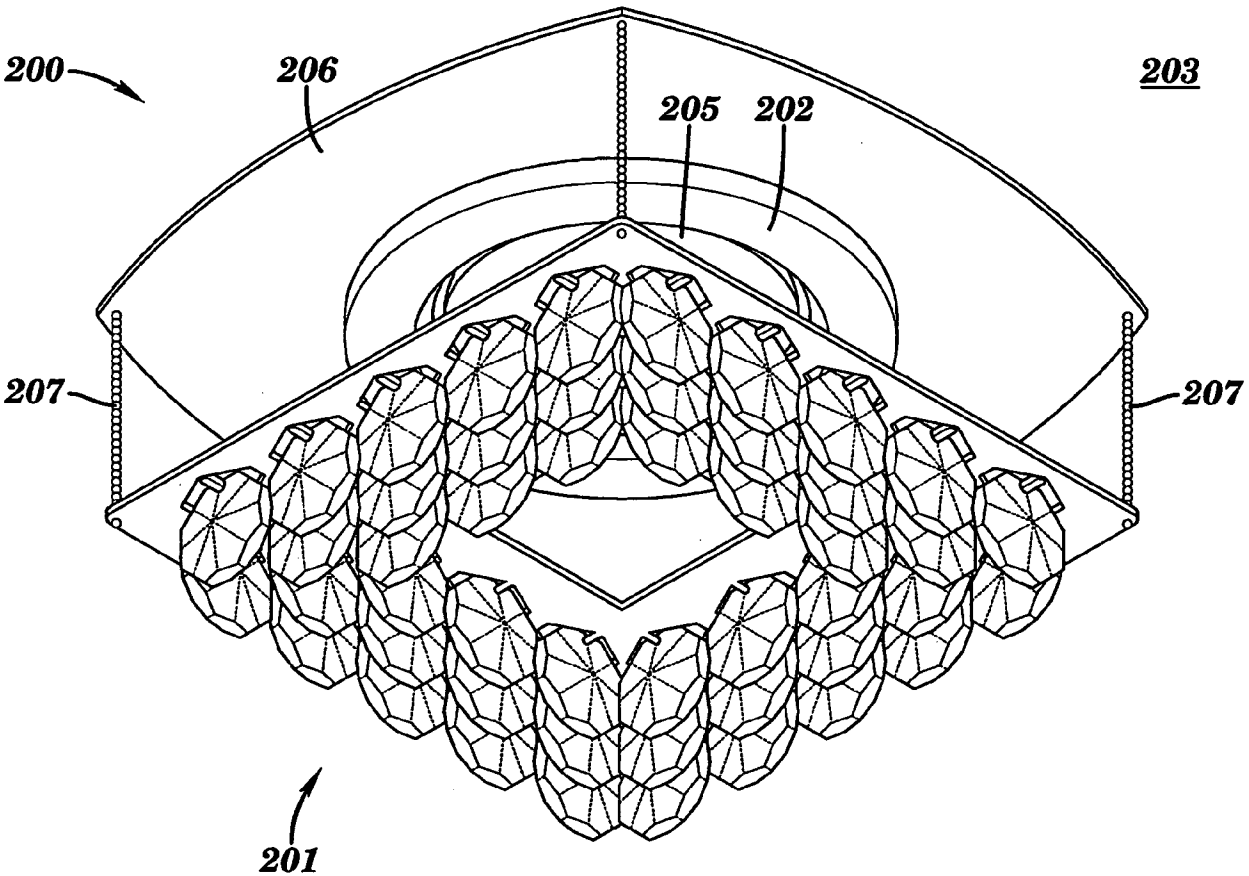

FIG. 26 is a perspective view of another light fixture 200 having an ornament fixture 201 suspended by chains or cords 207 according to another aspect of the invention. Ornament fixture 201 may be similar to the ornament fixtures shown in FIGS. 1 through 21. For instance, as shown in FIG. 26, in one aspect, ornament fixture 201 may be similar to the fixtures shown in FIGS. 2, 9, 10, 12, 13, 14, and 16. For example, as shown in FIG. 26, ornament fixture 201 may comprise the fixture 90 shown in FIG. 12.

As shown in FIG. 26, light fixture 200 includes a lamp holder 202 mounted above ornamental fixture 201. Lamp holder 202 may be mounted within a surface 203, that is, light fixture 200 may also comprise a "recessed" light fixture. In one aspect of the invention, light fixture 200 comprises a recessed light fixture powered by an electrical cord (not shown) located behind surface 203. Lamp holder 202 is adapted to hold a light bulb, or similar light source, 205. Light holder 202 includes an escutcheon 206. In one aspect of the invention, ornament fixture 201 may be suspended from escutcheon 206 by means of chains or cords 207, for example, by at least one chain or cord 207. Chains 207 may comprise any elongated tensile element, for example, chain, cord, rope, string, wire, etc. Chains 207 may also comprise rigid elements, such as mounting posts or rods. However, as shown in FIG. 26, in one aspect, chains 207 may comprise a plurality of ball chains. The ball chains may be mounted to escutcheon 206 and fixture 201 by conventional means, for example, chains 207 may be threaded through perforations or holes in escutcheon 206 and the frame of fixture 201 and may be suspended from these structures by larger diameter balls or connectors mounted to the ball chains. In one aspect of the invention, the length of chain or cord 207, or another tensile element, for example, a post or rod, may vary from about 0.125 inches to about 6 feet, depending, among other things, upon the size of the fixture. However, the length of chain, cord, post, or rod, 207 may typically vary from about 0.125 inches to about 6 inches. In one aspect of the invention, fixture 201 may be mounted directly to escutcheon 206, for example, by mechanical fasteners, without the use of, for example, a chain or rod 207. In one aspect of the invention, the ornaments in ornament fixture 201 may comprise one or more colors.

Figure 27:
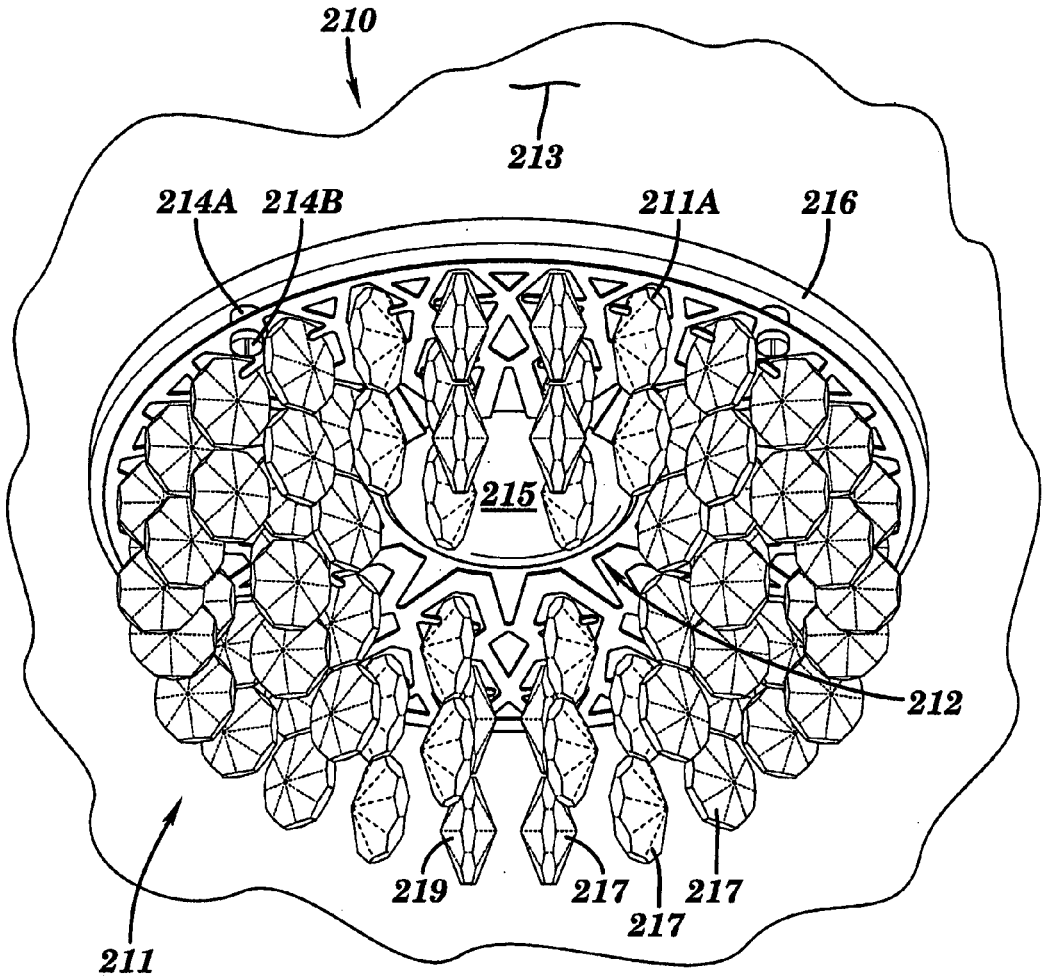

FIG. 27 is a perspective view of another light fixture 210 having an ornament fixture 211 according to another aspect of the invention. Ornament fixture 211 includes a frame 211A and a plurality of suspended ornament chains 217 having a plurality of octagonal ornaments 219, though in aspects of the invention any type ornament may be used, such as those described above with respect to ornaments 20 and 22. Ornament chains 217 may be mounted to frame 211A by means of one or more posts, pins, or wires as described above with respect to other aspects of the invention. Ornament fixture 211 may be similar to the fixtures described above and shown in FIGS. 1 through 26. For instance, as shown in FIG. 27, in one aspect, ornament fixture 211 may be similar to the fixtures shown in FIGS. 2, 9, 10, 12, 13, 14, 16, and 26. For example, as shown in FIG. 27, ornament fixture 211 may comprise the fixture 90 shown in FIG. 12 or the fixture 201 shown in FIG. 26.

As shown in FIG. 27, light fixture 210 includes a lamp holder 212 mounted above ornamental fixture 211. Lamp holder 212 may be mounted within a surface 213, that is, light fixture 210 may also comprise a "recessed" light fixture. In one aspect of the invention, light fixture 210 comprises a recessed light fixture powered by an electrical cord (not shown) located behind surface 213. Lamp holder 212 is adapted to hold a light bulb, or similar light source, 215. Light holder 212 includes an escutcheon 216. In one aspect of the invention, ornament fixture 211 may be mounted to escutcheon 216 by means of mechanical fasteners, such as spacers 214A and screws 214B. In one aspect of the invention, the length of spacers 214A may vary from about 0.125 inches to about 6 inches, depending, among other things, upon the size of the fixture. However, the length of spacers 214A may typically vary from about 0.125 inches to about 1 inch. In one aspect of the invention, the ornaments in ornament fixture 211 may comprise one or more colors.

FIGS. 28, 29, and 30 are a front elevation view, a side elevation view, and a rear elevation view, respectively, of another ornament fixture 220 according to another aspect of the invention. Arrangement 220 includes a plurality of ornaments 222, for example, a plurality of perforated ornaments, mounted in a frame 224 having apertures 223. Ornaments 222 may be mounted in frame 224 by means of pins or posts as discussed above, but, as shown in FIG. 30, in one aspect, ornaments 222 may be mounted to frame 224 by means of one or more wires or rods 226 (see FIG. 30). In one aspect ornaments 222 may be mounted to frame 224 by wires 226 in a fashion substantially identical to the aspect of the invention shown in FIGS. 13 through 16. For example, in one aspect, ornaments 222 may be mounted to frame 224 by engaging the perforations in ornaments 222 with wires 226 and then retaining the ornaments 222 in apertures 223 by means of the interaction of the internal surface of apertures 223 and wire 226 to retain and orient ornaments 222 in a predetermined orientation.

According to aspects of the present invention, ornaments 222 may comprise one or more of the ornaments described with respect to ornaments 20 and 22 above; frame 224 may comprise a frame having the attributes described with respect to frame 11 above; apertures 223 may comprise any shaped aperture adapted to accept an ornament 222; and wires 226 may comprise a wire, rod, or filament having the attributes described with respect to wire 106 above. In one aspect of the invention, frame 224 may comprise an essentially flat frame, a cylindrical frame, or a variety of three-dimensional shapes, for example, a sphere (for instance, a faceted sphere), a pyramid, various polyhedrons, and any other conventional three-dimensional shape. However, as shown most clearly in FIG. 29, in one aspect, frame 224 may comprise a curved perforated plate, in this case, having a sinuous shape as shown. According to one aspect of the invention, the radius of curvature of frame 224 may vary from about 1 inch to about 10 feet, depending, among other things, upon the size of the fixture 220.

FIG. 30 illustrates one of the many advantages of aspects of the present invention. As shown, the ornaments 222 of fixture 220 are arranged in a linear fashion, that is, the ornaments 222 are arranged in rows 225. According to aspects of the invention, arranging ornaments 222 into rows 225 may facilitate the assembly of fixture 220. Specifically, by aligning ornaments 222 into rows 225 whereby the perforations of ornaments 222 may be substantially aligned, an assembler may more easily pass a wire or rod 226 through the apertures to engage the ornaments in apertures 223. In one aspect of the invention, the passing or threading of the wire or rod 226 may be practiced manually; in another aspect, the wire or rod 226 may be passed or threaded automatedly, for example, by means of a robotic manipulator. In the aspect of the invention shown in FIGS. 28 through 30, ornaments 222 may be arranged in interlaced or interdigitated rows 225 of diamond-shaped apertures 223, for example, to accommodate the octagonal shape of ornaments 222. However, according to aspects of the invention, apertures 223 may be arranged and shaped in any convenient manner to accommodate the shape of ornament 222 and the alignment of the perforations of ornaments 222 to facilitate assembly. In one aspect of the invention, the alignment of ornaments 222 may not be linearly arranged, but the alignment of at least one of the ornaments 222 may vary from linearity, as dictated by the desired design. For example, as shown in FIGS. 13 and 14 above, ornaments 222 may be arranged in a curved fashion, for example, on a curved line or in a circular or elliptical pattern. In another aspect, the arrangement of ornaments 222 may include dislocations or displacements, for example, exhibiting little or no linearity. In one aspect of the invention, these non-linear arrangements may be accommodated by manual threading of wire 226 or by passing two or more wires 226 through the ornaments 222. Other arrangements of ornaments 222 and apertures 223 will be apparent to those of skill in the art.

As will be appreciated by those skilled in the art, features, characteristics, and/or advantages of the ornament mounting arrangements, ornament mounting methods, and ornamented fixtures described herein, may be applied and/or extended to any embodiment (for example, applied and/or extended to any portion thereof).

Although several aspects of the present invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims and their equivalents.

The invention claimed is:

1. An arrangement for mounting decorative ornaments, each ornament having a center of gravity and at least one perforation that does not pass through the center of gravity of the ornament, the arrangement comprising:

a frame having a plurality of apertures, the apertures having an internal surface; and at least one mounting post adapted for insertion through a perforation of at least one of the ornaments;

wherein the ornaments are retained by the at least one mounting post and the at least one internal surface of the aperture in a predetermined orientation substantially perpendicular to the mounting post when the ornaments are mounted to the mounting post.

2. The arrangement as recited in claim 1, wherein the at least one mounting post is one of at least one mounting post integrally mounted to the frame and at least one mounting post not integrally mounted to the frame.

3. The arrangement as recited in claim 1, wherein the internal surface of the aperture comprises a continuous internal surface.

4. The arrangement as recited in claim 1, wherein the ornament is further retained by an adjacent ornament.

5. The arrangement as recited in claim 1, wherein the aperture comprises one of a circular aperture, an elliptical aperture, a polygonal aperture, and a triangular aperture.

6. The arrangement as recited in claim 1, wherein the decorative ornament comprises at least one of a bead, a crystal, a stone, and a gem.

7. The arrangement as recited in claim 1, wherein the mounting post comprises one of a wire and a pin.

8. The arrangement as recited in claim 1, wherein each of the ornaments is retained in each of the plurality of apertures in the frame.

9. A fixture for mounting perforated ornaments having a center of gravity and at least one perforation that does not pass through the center of gravity of the ornament, the fixture comprising:

a frame having a plurality of apertures, the plurality of apertures having internal surfaces; and at least one mounting post mounted to the frame adapted for insertion through at least one of the perforations of the perforated ornaments;

wherein the ornaments are retained in the plurality of apertures by the at least one mounting post and the internal surfaces of the apertures in a predetermined orientation substantially perpendicular to the mounting post when the ornaments are mounted to the mounting post.

10. The fixture as recited in claim 9, wherein the at least one mounting post comprises a plurality of mounting posts.

11. The fixture as recited in claim 9, wherein the fixture comprises a light fixture.

12. The fixture as recited in claim 10, wherein the light fixture comprises one of a chandelier, lamp, and wall sconce.

13. The fixture as recited in claim 9, wherein the ornaments are further retained by an adjacent ornament.

14. The fixture as recited in claim 9, wherein the frame comprises one of a substantially fiat frame, a substantially cylindrical frame, curved frame, a spherical frame, a pyramidal frame, and a polyhedral frame.

15. The fixture as recited in claim 9, wherein the at least one mounting post is rigidly mounted to the frame.

16. The fixture as recited in claim 9, wherein the at least one mounting post comprises one of at least one wire and at least one pin.

17. The fixture as recited in claim 9, wherein each of the ornaments is retained in each of the plurality of apertures in the frame.

* * * * *

UNITED STATES PATENT AND TRADEMARK OFFICE

CERTIFICATE OF CORRECTION

PATENT NO. : 7,267,463 B2
APPLICATION NO. : 11/031153
DATED : September 11, 2007
INVENTOR(S) : Bayer et al.

It is certified that error appears in the above-identified patent and that said Letters Patent is hereby corrected as shown below:

In The Claims:

Claim 14, col. 22, line 54: Delete "comprises one of a substantially fiat frame," and insert -- "comprises one of a substantially flat frame,--

Signed and Sealed this

Twentieth Day of November, 2007

JON W. DUDAS
*Director of the United States Patent and Trademark Office*